US006884333B2

(12) United States Patent
Landau

(10) Patent No.: US 6,884,333 B2
(45) Date of Patent: Apr. 26, 2005

(54) ELECTROCHEMICAL SYSTEM FOR ANALYZING PERFORMANCE AND PROPERTIES OF ELECTROLYTIC SOLUTIONS

(76) Inventor: Uziel Landau, 13909 Larchmere Blvd., Shaker Heights, OH (US) 44120

( * ) Notice: Subject to any disclaimer, the term of this patent is extended or adjusted under 35 U.S.C. 154(b) by 0 days.

(21) Appl. No.: 10/900,007

(22) Filed: Jul. 27, 2004

(65) Prior Publication Data

US 2004/0262152 A1 Dec. 30, 2004

Related U.S. Application Data

(63) Continuation of application No. 10/791,169, filed on Mar. 2, 2004, which is a continuation-in-part of application No. 10/267,505, filed on Oct. 9, 2002, now abandoned.

(51) Int. Cl.[7] ..... C25D 21/12; G01N 27/26

(52) U.S. Cl. ..... 205/81; 205/82; 205/83; 205/84; 205/775; 205/775.5; 205/790; 205/790.5; 205/791; 205/791.5; 205/793.5; 204/400; 204/404; 204/412; 204/434; 204/228.1; 204/228.7; 204/229.8; 204/242; 204/280

(58) Field of Search ..... 205/81, 82, 83, 205/84, 775, 775.5, 790, 790.5, 791, 791.5, 793.5; 204/400, 404, 412, 434, 228.1, 228.7, 229.8, 242, 280

(56) References Cited

U.S. PATENT DOCUMENTS

| | | | |
|---|---|---|---|
| 2,149,344 | A | 3/1939 | Hull |
| 2,760,928 | A | 8/1956 | Ceresa |
| 2,801,963 | A | 8/1957 | Hull et al. |
| 2,859,166 | A | 11/1958 | Grigger |
| 3,121,053 | A | 2/1964 | Hull, Jr. et al. |

(Continued)

OTHER PUBLICATIONS

Cell–Design©, Software for computer–aided–design of electrochemical cells, L–Chem Inc,, 13909 Larchmere Blvd. Shaker heights, OH 44120. Website: www.L–Chem.com, no date given.

(Continued)

*Primary Examiner*—Robert R. Koehler
(74) *Attorney, Agent, or Firm*—Howard M. Cohn

(57) ABSTRACT

The invention relates to the analysis of the performance and properties of electrochemical processes, and specifically, to electrolytic solutions and electrode processes. The invention discloses a device and a method for obtaining qualitative and quantitative information for the kinetics of the electrode reactions, the transport processes, the thermodynamic properties of the electrochemical processes taking place in the cell. When a deposition reaction takes place, the device provides also valuable information about the relationship between the current density and deposit properties including but not limited to the deposit color, luster, and other aspects of its appearance. The device disclosed herein typically is comprised of a multiplicity of cathodic or anodic regions where one or more electrochemical reactions take place simultaneously, but at a different rate. From the precisely measured segmental currents one can obtain among other process properties: (1) An accurate relationship between the deposit appearance and the current density. This relationship can be used for process diagnostics, troubleshooting, control of concentrations, pH, and additives and contaminants and for optimizing the operating conditions, including the voltage, current, and circulation rate. (2) Quantitative determination of important process parameters including but not limited to, kinetics (e.g., exchange current density, cathodic and anodic transfer coefficients), transport (e.g. conductivity), and thermodynamics (e.g., standard potential). A particularly attractive application of the process is for the quantitative and qualitative processes of alloys plating and for the determination of the relationship between the current efficiency and the applied current density.

44 Claims, 14 Drawing Sheets

U.S. PATENT DOCUMENTS

| | | | | |
|---|---|---|---|---|
| 4,252,027 A | | 2/1981 | Ogden et al. | |
| 4,605,626 A | | 8/1986 | Beck | |
| 4,695,360 A | * | 9/1987 | Asatiani et al. | 204/404 |
| 5,228,976 A | | 7/1993 | Abys et al. | |
| 5,413,692 A | | 5/1995 | Abys et al. | |
| 6,113,771 A | | 9/2000 | Landau et al. | |

OTHER PUBLICATIONS

I. Kadija, J. A. Abys, V. Chinchankar and K. Straschil, Hydrodynamically Controlled "Hull Cell", Plating and Surface Finishing, Jul., 1991.

Autolab HT RotaHull, designed by D. Landolt and C. Madore, manufactured and distributed by Eco Chemie, BV, Utrecht, The Netherlands, no date given.

J. S. Newman, Electrochemical Systems, Prentice–Hall, Inc., Englewood Cliffs, N.J. (1973), pp. 107–109, no month given.

A. J. Bard and L. Faulkner, "Electrochemical Methods", John Wiley and Sons, N.Y. 1980, no month given.

Venjamin G. Levich, "Physicochemical Hydrodynamics", Prentice–Hall, Englewood Cliffs, NJ, 1962, pp. 60, 61, 71, and 72, no month given.

Uziel landau, "Determination of Laminar and Turbulent Mass Transport Rates in Flow Cells by the Limiting Current Technique", AIChE Symposium Series 204, vol. 77, pp. 75–87, 1981, no month given.

* cited by examiner

*Fig. 3F (Cross-Section A-A)*

*Fig. 3H (Cross-Section B-B)*

*Fig. 9C (Cross-Section A-A)*

*Fig. 9D (Cross-Section B-B)*
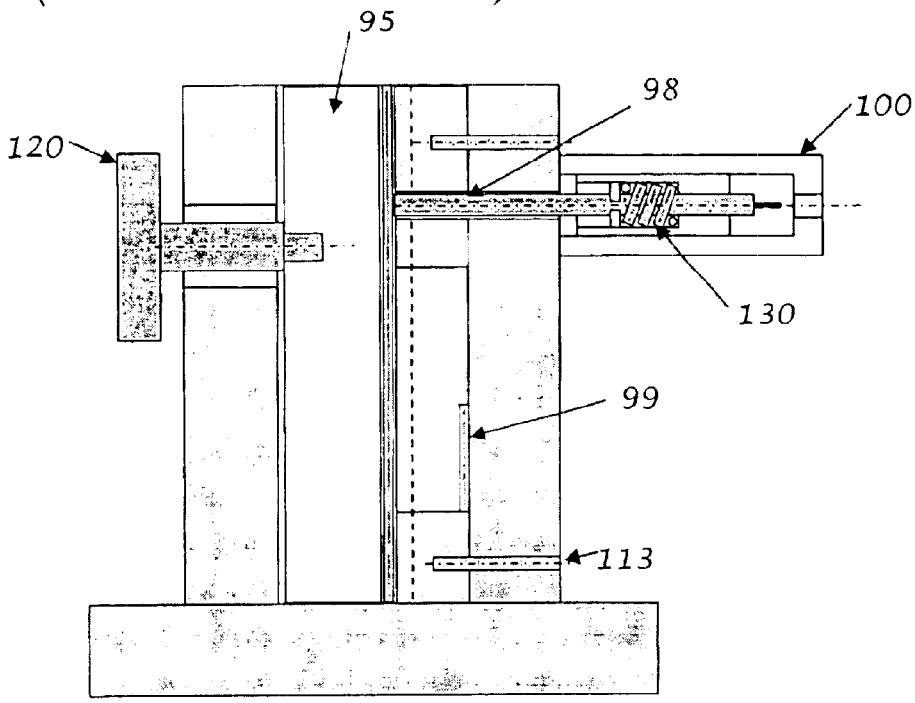
*Fig. 9E*
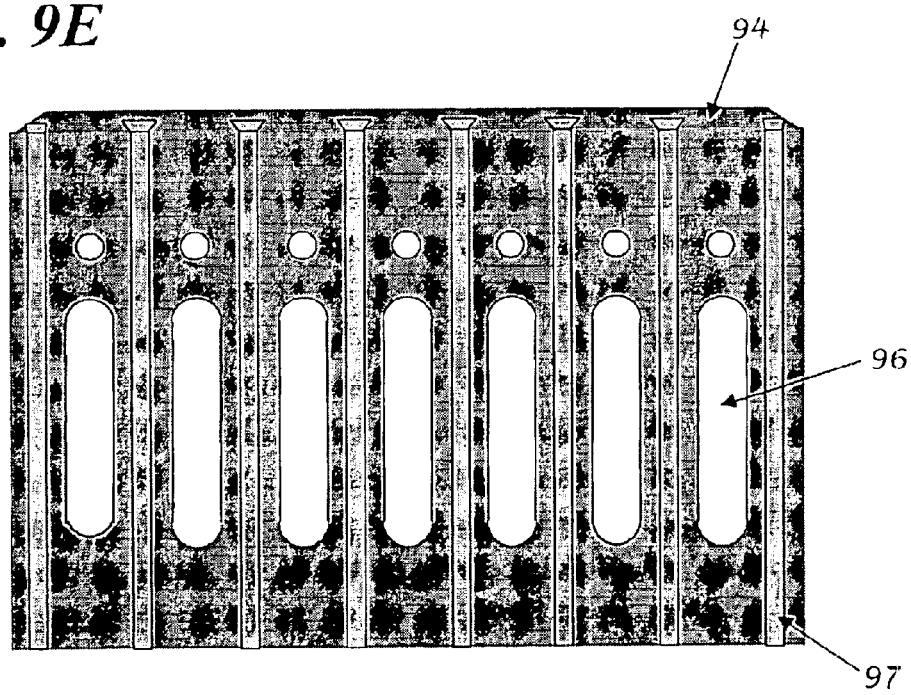

ELECTROCHEMICAL SYSTEM FOR ANALYZING PERFORMANCE AND PROPERTIES OF ELECTROLYTIC SOLUTIONS

RELATED APPLICATIONS

This is a Continuation of U.S. application Ser. No. 10/791,169 which in turn is a Continuation-in-Part application of U.S. application Ser. No. 10/267,505 now abandoned, having a filing date of Mar. 2, 2004 and Oct. 9, 2002 respectively.

References Cited

U.S. Patent Documents

| | | | |
|---|---|---|---|
| 2149344 | March 1939 | Hull | 204/153. |
| 2760928 | August 1956 | Ceresa | 204/434. |
| 2801963 | August 1957 | Hull et al. | 204/434. |
| 2859166 | November 1958 | Grigger | 204/DIG. |
| 3121053 | February 1964 | Hull, Jr. et al. | 204/434. |
| 3215609 | November 1965 | Chapdelaine | 204/434. |
| 3278410 | October 1966 | Nelson | 204/290. |
| 3281338 | October 1966 | Leary et al. | 204/290. |
| 3356597 | December 1967 | Schmidt | 204/434. |
| 3616287 | October 1971 | Draghicescu et al. | 204/DIG. |
| 4102770 | July 1978 | Moriarty et al. | 204/212. |
| 4252027 | February 1981 | Ogden et al. | 73/826. |
| 4605626 | August 1986 | Beck | 204/403. |
| 5,228,976 | July 1993 | Abys et. al. | |
| 5,413,692 | May 1995 | Abys et al. | |
| 6,113,771 | September 2000 | Landau et. al. | |

Other References

1. Cell-Design©, Software for computer-aided-design of electrochemical cells, L-Chem Inc, 13909 Larchmere Blvd. Shaker heights, OH 44120. Website: www.L-Chem.com
2. I. Kadija, J. A. Abys, V. Chinchankar and K. Straschil, "*Hydrodynamically Controlled "Hull Cell"*, Plating and Surface Finishing, July, 1991.
3. Autolab HT RotaHull, designed by D. Landolt and C. Madore, manufactured and distributed by Eco Chemie, BV, Utrecht, The Netherlands.
4. J. S. Newman, Electrochemical Systems, Prentice-Hall, Inc., Englewood Cliffs, N.J. (1973).
5. A. J. Bard and L. Faulkner, "*Electrochemical Methods*", John Wiley and Sons, N.Y. 1980.
6. Venjamin G. Levich, "*Physicochemical Hydrodynamics*", Prentice-Hall, Englewood Cliffs, N.J., 1962.
7. Uziel landau, "*Determination of Laminar and Turbulent Mass Transport Rates in Flow Cells by the Limiting Current Technique*", AIChE Symposium Series 204, Vol. 77, pp. 75–87, 1981

BACKGROUND OF THE INVENTION

1. Field of the Invention

The invention relates to the field of analyzing the properties of electrolytes and testing the performance of electrochemical processes. The invention focuses on electroplating processes, although it can also be directly applied to other electrolytic processes including, but not limited to, electrowinning, electrorefining, and anodizing.

2. Background of the Invention

The performance of electrochemical systems depends on the design of the cells in which the electrochemical reactions take place and on the appropriate selection of the operating conditions, including current, voltage, electrolyte composition, species concentrations, flow, etc., to produce the desired results. The selection of the operating conditions is particularly critical in plating cells where the deposit thickness distribution and properties (e.g., appearance, color, surface texture, adhesion, and composition) strongly depend on the cell configuration and the process parameters. In order to obtain adequate quality product, practitioners often utilize two approaches: (i) experimental—a test fixture or apparatus e.g., the "Hull cell" [described e.g., in U.S. Pat. Nos. 2,149,344, 2,801,963, 3,121,053] is used to generate, by specifying and controlling the total current, a sample that is plated under a range of current densities. The sample is visually inspected and correlated with the process conditions; (ii) modeling—where the electrochemical process is mathematically analyzed and the conditions to produce the desired results are sought. In recent years, the latter approach has been enhanced by simulations using computer-aided-design ('CAD') software e.g., Cell-Design® [Ref. 1]. Knowing the process parameters (e.g., kinetics constants, standard potential, and conductivity) is an essential prerequisite for the modeling approach. Yet, this data is typically not available, particularly not for commercial electrolyte formulations, and generating this data is quite onerous.

As discussed below, both these approaches ('experimental deposition onto a test fixture' and 'modeling') suffer at present from a number of shortcomings that the invention disclosed herein resolves.

Limitations of the Current Approaches:

A. Limitations of Special Fixtures and Devices that Characterize Deposits Produced Under a Range of Current Densities The most commonly used device to experimentally explore a deposit produced under a range of current densities is the 'Hull cell' [U.S. Pat. Nos. 2,149,344, 2,801,963, 3,121,053]. The Hull cell, shown in FIG. 1A, is a prismatic cell with vertical insulating sidewalls, an anode panel (2) and a slanted cathode panel (3). Due to the different angles of the corners between the slanted cathode and its neighboring insulating sidewalls (acute angle (4) at one side of the cathode and an obtuse angle (5) at the other side), and the varying distance between regions on the cathode and the anode, the deposit is plated on the cathode under a non-uniform current density: the highest current density (and correspondingly, the thickest deposit) is near the corner with the obtuse angle (5); the lowest current density (and thinnest deposit) is next to the corner with the acute angle (4). The current density and the corresponding deposit thickness vary between the two corners in a non-linear fashion. Since, only the total current to the entire cathode can be measured in the Hull cell, users are given a scale (6), shown in FIG. 1B, on which the expected current density is indicated as a function of position. By placing this scale alongside the cathode panel (3), as shown in FIG. 1B, users can estimate the current density that corresponds to the deposit at the given location. The major deficiency of the Hull-cell is that the current density indicated on the scale is only a rough approximation. This approximation is inherent and cannot be improved because the current distribution does not depend only on the cell geometry, as implied in the Hull-cell description, but it varies with the type of plating solution used. For example, lead and zinc deposition produce a highly non-uniform distribution; copper plating produces a moderately uniform distribution, and nickel, iron and gold produce significantly more uniform distribution. The curves displayed in FIG. 2 show the computed current density distributions in typical electrolytes (copper from acidified copper sulfate, and Watts-type nickel), as modeled by Cell-Design© CAD software, in comparison to the corresponding value indicated by the Hull cell scale. As noted in FIG. 2, even for those very common electrolytes, significant differences (exceeding 25%) at the low and high current density ranges exist. An even more serious obstacle to using the Hull cell for the selection of the proper operating conditions is the variation of the current distribution due to variations in the electrolyte's temperature, ionic concentrations, conductivity, additive concentration, contaminants and by-products, which are supposed to be analyzed by the Hull cell test, yet their effects on the current density is not indicated. Accordingly, there exists a significant uncertainty in matching the deposit at any given location along the Hull-cell cathode to the actual prevailing local current density. Furthermore, the deposit thickness varies gradually and continuously along the cathode. Since the user relies on visual inspection of the deposit to determine whether the appearance of the latter is satisfactory, it is difficult to clearly differentiate the acceptable range.

Another device that is occasionally used to determine the properties of the plating electrolyte is the Haring-Blum cell. Here, two parallel cathodes are positioned at two different distances, on both sides of a common anode. The ratio of the deposit weights on the cathodes characterizes the throwing power of the electrolyte, which is proportional to the ratio between the deposition reaction resistance and the electrolyte resistance. While the Haring Blum cell provides the throwing power (or the resistance ratio) at only one current density in each experiment, there is a need to provide this ratio across a broad range of current density in a single experiment.

Two variations on the Hull cell have been subsequently suggested. One is the Casey-Asher cell which has an elongated rectangular cross-section, where the non-uniform deposition takes place along one of the elongated electrodes. The second is the pie-shaped Tena cell, consisting of two concentric cylindrical insulating walls bound by two radially positioned planar electrodes. Both of the variations on the Hull cells, while not widely used, suffer from the same deficiencies as the Hull cell.

More recently, Abys et. al. introduced the 'hydro dynamically modulated Hull cell' [Ref. 2 and U.S. Pat. Nos. 5,228,976 and 5,413,692], which was designed to provide improved and better quantified mass transport. The cell consists of a cylindrical rotating cathode and an anode positioned to provide a non-uniform current distribution. Specially positioned baffles help adjust the current distribution. This cell suffers from the same limitations that apply to the Hull cell, i.e., it provides a distribution that depends on the electrolyte type and composition, and not just on the geometry. Furthermore, since only the total current is measurable, the deposit at any given location along the cathode cannot be precisely associated with a specific current density. Another very similar cell that has recently been introduced by Landolt and Madore [Ref. 3], has identical features to Abys' et. al. cell and suffers from the same shortfalls.

None of the cells described above provides any quantitative information concerning the physical and/or chemical parameters of the process.

B. Difficulty in Obtaining Electrochemical Process Parameters

A major impediment to applying quantitative modeling (both analytical and computer-aided design) to electrochemical systems is the paucity of available property data that such modeling requires. Typically, thermodynamic, kinetics, and transport properties are needed in order to characterize the processes that take place in electrochemical cells. These processes can be generally divided into two major categories: (a) processes associated with the electrode reactions and (b) ionic transport in the electrolyte.

The electrode processes are quite complex and typically involve numerous steps that are difficult to unravel. Their characterization can, however, be accomplished without detailed mechanistic knowledge by specifying the global thermodynamics and kinetics parameters. However, obtaining this data is typically quite difficult. The thermodynamics properties include the standard reaction potential ($E^0$) whose value can be found in standard thermodynamic tables. However, the actual equilibrium potential (E) depends also on the temperature, the electrolyte concentration (ionic activities) and particularly on the composition, including species that complex the reacting ion and that modify the adsorption properties on the electrode. Determination of the effects of all these parameters is quite difficult and requires at the bare minimum the use of a special, well characterized, reference electrode [Refs. 4, 5]. Specification of the electrode kinetics requires a polarization curve that describes the dependence of the electrode overpotential (=potential exceeding the equilibrium potential due to irreversible dissipative processes, e.g., kinetics resistance) as a function of the current density. Commonly, the polarization curve is represented in terms of the Butler-Volmer equation, which has some fundamental justification, but in practice serves mostly as a correlation, i.e., the parameters are determined empirically through polarization experiments. Although the physical significance of the parameters in this equation can be attributed only in very few simple processes, the general form of this equation and its three adjustable parameters (exchange current density [$i_0$], anodic [$\alpha$]and cathodic [$\beta$] transfer coefficients) that are measured empirically, have enabled to model numerous electrochemical processes. The general application of the Butler-Volmer equation, or other polynomial correlations that have been suggested, from data in the literature is, however, limited because of the interdependence of the electrode kinetics on the transport, and particularly on the reactant (and additives) concentration at the surface. These in turn, depend not only on the convective and diffusive transport but also on the current density, both of which typically vary along electrodes and with operating conditions.

Ionic transport in the electrolyte involves diffusion, migration and convection. Its simulation requires knowing the 'integral' diffusion coefficient of the reacting species. The latter can be measured on a rotating disk electrode assembly as introduced by Venjamin Levich in his book "Physicochemical Hydrodynamics" published by Prentice-Hall, Englewood Cliffs, N.J., 1962, which is incorporated herein by reference [6]. The experimental set-up is, however, costly. It requires a rotating disk electrode assembly, a power supply with current/voltage ramp capability and data recording capability. The process of generating the data is time consuming, and requires expertise as described, e.g., in a paper by Uziel Landau, "Determination of Laminar and Turbulent Mass Transport Rates in Flow Cells by the Limiting Current Technique", AICHE Symposium Series 204, Vol. 77, pp. 75–87, 1981, which is incorporated herein by reference [7]. In addition, one needs to characterize the mass transport process in the cell. This typically amounts to specifying the mass transport boundary layer thickness, and its distribution in the cell, or equivalently, the limiting diffusion current. These are quite difficult to determine since they depend on detailed characterization of the flow in the cell and on the cell configuration, typically requiring computational fluid dynamics modeling. Even where forced convection is not present or is not dominant, determining the characteristics of the diffusion flux in complex geometries is difficult.

Ionic transport also proceeds via electric migration that is characterized by the conductivity. The latter varies with the electrolyte composition, concentration (i.e. it is affected by the local current density or concentration gradients), and temperature.

In addition to the difficulty in characterizing the details of the electrochemical process so that proper parameters can be assigned, there is a difficulty in obtaining the data and in particular, the kinetics parameters (e.g., $i_0$, $\alpha$ and $\beta$, as described above). The literature typically offers only rate constants for pure elements (and even those are given for only one standard concentration or activity). Practical processes, and in particular plating systems, employ complex chemistries, incorporating additives and complexing agents that strongly affect the deposition kinetics, as described e.g. by U. Landau et. al., in U.S. Pat. No. 6,113,771. It is therefore required in almost all practical situations to experimentally measure the parameters for the given system. Such measurements require, however, special cells that are specifically designed for the type of measurement. Examples include conductivity cells coupled with high frequency analyzer for conductivity measurement, and rotating disk electrode for measurements of diffusivity. The rate constants, $i_0$, $\alpha$ and $\beta$, must be typically obtained by conducting a sweep of a current-potential scan in cells that are difficult to design because of the requirement for (a) a uniform current density on the tested electrode (otherwise a meaningless average is detected), (b) uniform and tractable transport rates to the electrode, (c) means of detecting and subtracting the ohmic and concentration overpotentials, and (d) a three electrode system incorporating a reference electrode so that the potential of the test electrode can be elucidated. Special and costly power supplies ('potentiostats') that are capable of three-electrode voltage control versus a reference electrode are also required. The kinetics constants are typically extracted from polarization curves, hence a dynamic measurement in which the cell voltage or current are ramped by the power supply over sufficiently wide range must be implemented. These experimental procedures are described in the literature, e.g., in a book by Allen Bard and Larry Faulkner, "Electrochemical Methods" published by John Wiley & Sons, NY, 1980, which is incorporated herein by reference [5]. The special experimental techniques require procedures that many practical engineers are not proficient in, nor have the time to learn and carry out.

SUMMARY OF THE INVENTION

The present invention relates specifically to testing, characterization, and obtaining quantitative data for processes taking place in electrochemical cells. It provides innovation in two major aspects: (1) describing a device with multiple discrete electrode sites at which electrochemical reactions proceed simultaneously at different and precisely measured rates (=current densities). In a preferred embodiment, the reaction produces under precisely measured different current densities, multiple discrete deposit patches, which can then be studied visually and analytically (using analytical instrumentation, e.g., x-ray or electron microscopy), and thus provide a correlation between the appearance of the deposit and the current density at which it was produced. By comparing the measured deposit thickness on the different segments to their local current density, a measure of the current efficiency as function of the current density is obtained. When an alloy is deposited, measuring the segmental composition will yield the partial current densities for each component. (2) A method for extracting essentially the entire quantitative data needed to model the electrochemical system from a single deposition experiment carried in a device that provides simultaneously different current densities on separate electrodes or electrode segments, such as the device disclosed above. The data derived includes the equilibrium potential, the polarization curve and the associated kinetics constants ($i_0$, $\alpha$, $\beta$), and the electrolyte conductivity. In alloy deposition, when the segmental compositions are measured, the kinetics for the entire alloy system can be obtained from this single experiment. Such alloy data cannot be generated by the corresponding current/potential scanning experiment.

The key to the invention is the provision of numerous discrete regions on the same substrate, each carrying a different, measurable current density. This provides precise deposit patches, each corresponding to a different and precisely known current density. Furthermore, since both the (different) current densities and the voltages across each of those regions are measured, the data generated in a single experiment provides a multi-point correlation between the current density and the potential, i.e., this single steady-state experiment is the equivalent of an entire conventional current-voltage scan. The data collected in this single experiment can also yield the conductivity and the equilibrium potential. Among the advantages of the invention is that the extensive data can be generated in a single, simple, steady-state experiment. It does not require expensive instrumentation or electrochemical expertise, and the need for a time-dependent current/voltage scan and its associated complications, is eliminated. Transforming the experiment from a time domain of sweeping the current into the spatial domain of measuring a steady-state distributed reaction rates, offers numerous advantages. First, issues of unsteady-state and transients in the measurements are eliminated. When the current/voltage is scanned in a conventional experiment, the scan rate should not be too slow, in order to avoid deposit build-up which, particularly when rough, may alter the electrode morphology and area; nor should the scan be too fast, in order to avoid unsteady-state and transient effects. Also, unlike in the device disclosed herein, conventional scanning of the current (or voltage) produces a deposit that had been accumulated over a range of current densities; hence it is no longer useful for inspection.

Some aspects of the invention are also useful for characterization of electro-dissolution, electropolishing, and corrosion processes. For clarity, the discussion henceforth focuses on electroplating. Primarily, the invention addresses the difficulty in determining the properties of electrolyte solutions and on predicting the effects of the process conditions on the product, i.e., on the deposit. Although the main application of the invention is for electrodeposition systems in which a deposit builds up on the substrate, the device and method claimed herein are also useful for analyzing electrochemical processes in which no solid deposit forms. Electrochemical reactions that fall under this category include electrolytic manufacture of gaseous and liquid chemicals, redox reactions, electrolytic gas evolution, various electrodissolution processes and corrosion. In the absence of a deposit, the claimed device and method will still yield for those processes the electrochemical process parameters, i.e., the thermodynamic, kinetics and transport data that are required for modeling these processes.

According to the present invention, there is disclosed an electrochemical device, comprising a cell with a plurality of discrete cathodic or anodic regions at which one or more electrochemical reactions occurs; and means for causing the one or more electrochemical reactions at each of the plurality of discrete regions whereby each of the one or more electrochemical reactions is measurable and quantifiable.

Further, according to the present invention, an electrochemical device for simultaneously forming a plurality of electroplated deposits at a plurality of discrete cathodic or anodic regions at which one or more electrochemical reactions occurs comprises a cell with base, an enclosure such as a cover or a mask, and a plated, segmented substrate the substrate having a plurality of discrete cathodic or anodic regions at which one or more electrochemical reactions occurs clamped therebetween.

Still further, according to the present invention, process for determining the quality of electroplated deposits comprises simultaneously depositing a plurality of discrete deposits, each at one of a plurality of discrete cathodic or anodic regions at which one or more electrochemical reactions occurs; and causing the one or more electrochemical reactions at each of the plurality of discrete regions whereby each of the one or more electrochemical reactions is measurable and quantifiable.

Further yet, according to the present invention, a method is disclosed for determining electrochemical process parameters from currents or voltages measured while at least one electrochemical reaction takes place at different measurable rates on a plurality of distinctly different cathodic or anodic regions in an electrochemical device.

BRIEF SUMMARY OF THE FIGURES

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Figure 1A:
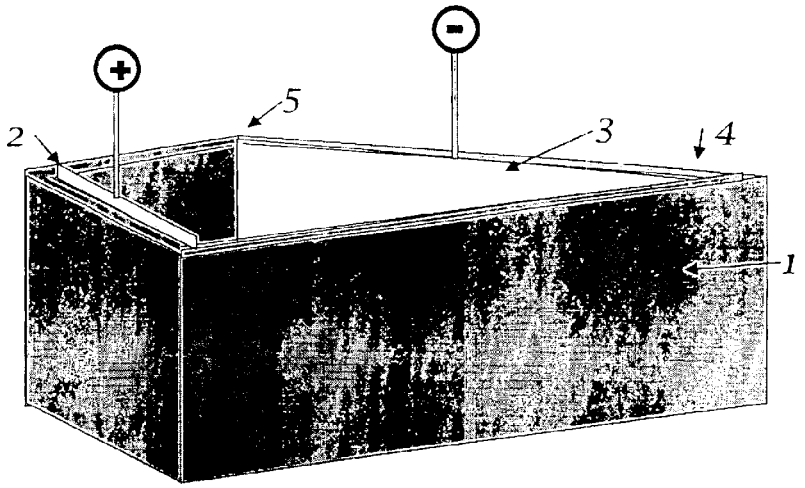
Fig. 1A (PRIOR ART)
Figure 1B:
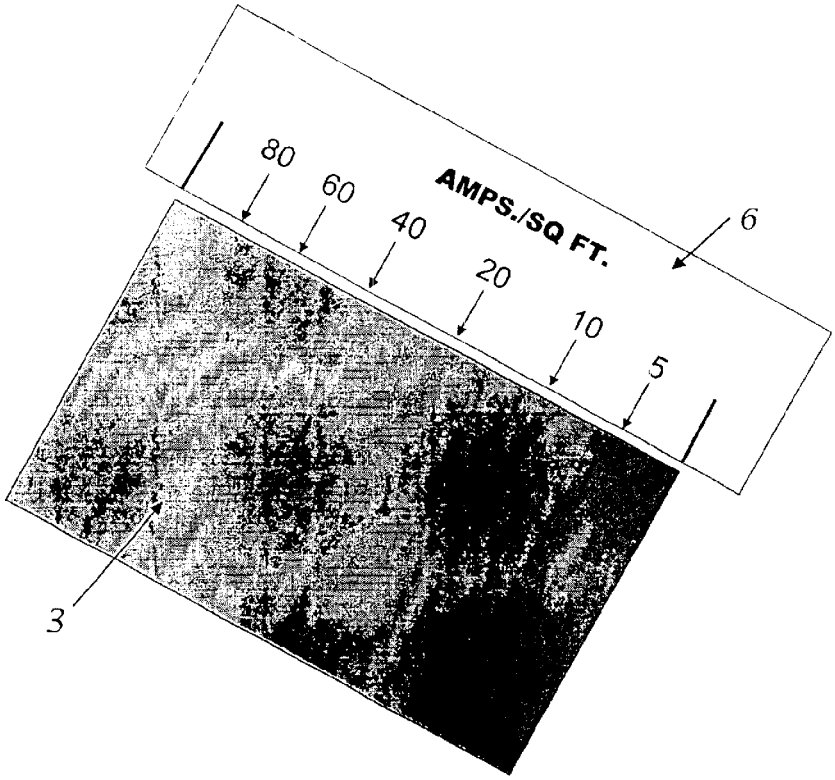
Fig. 1B (PRIOR ART)
Figure 2:
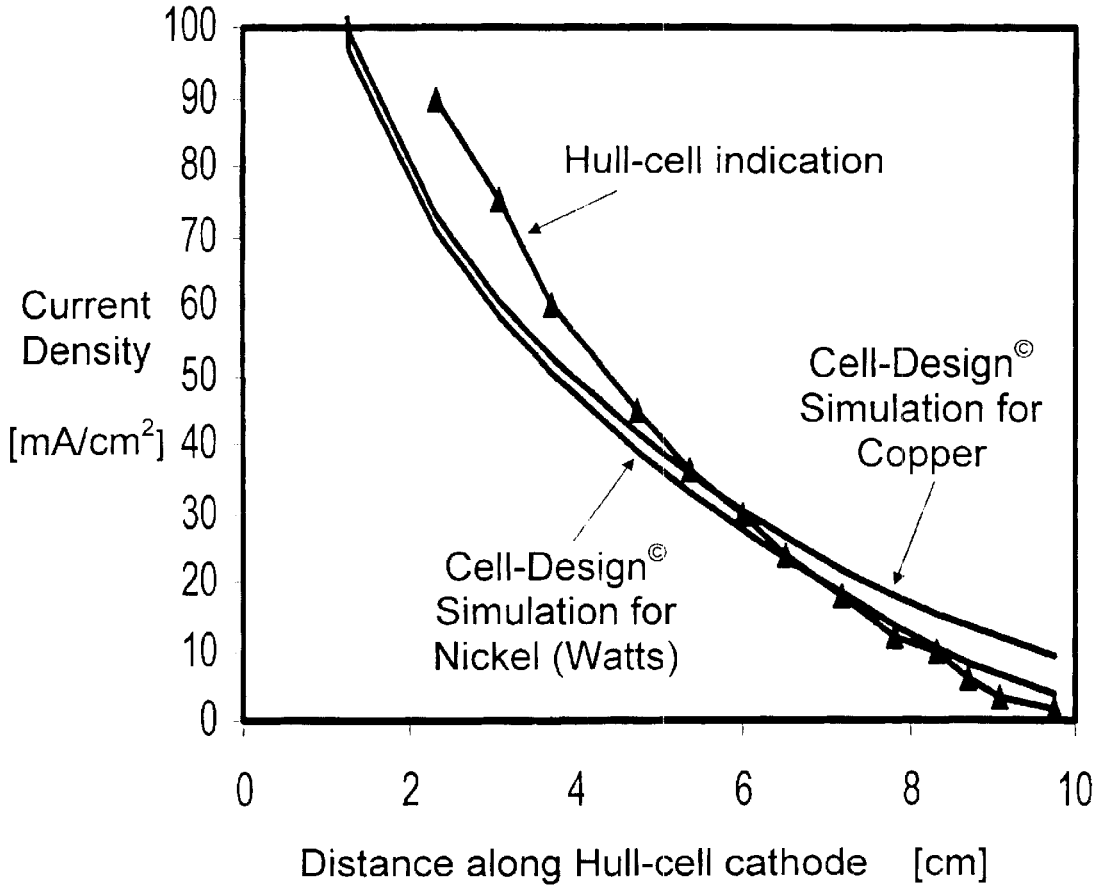
Figure 3A:
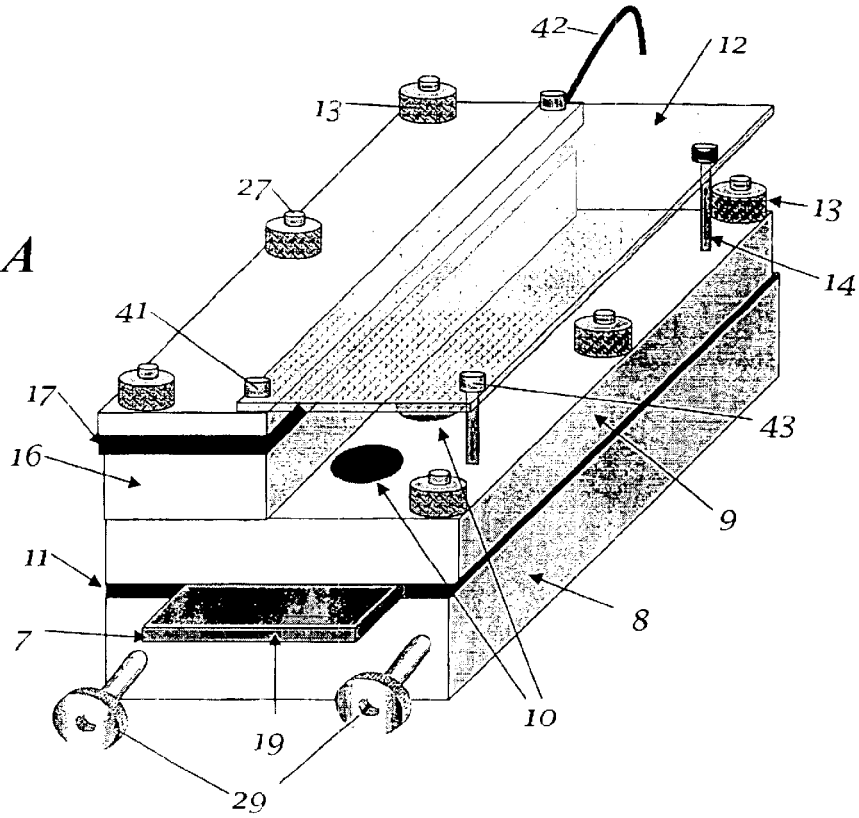
Figure 3B:
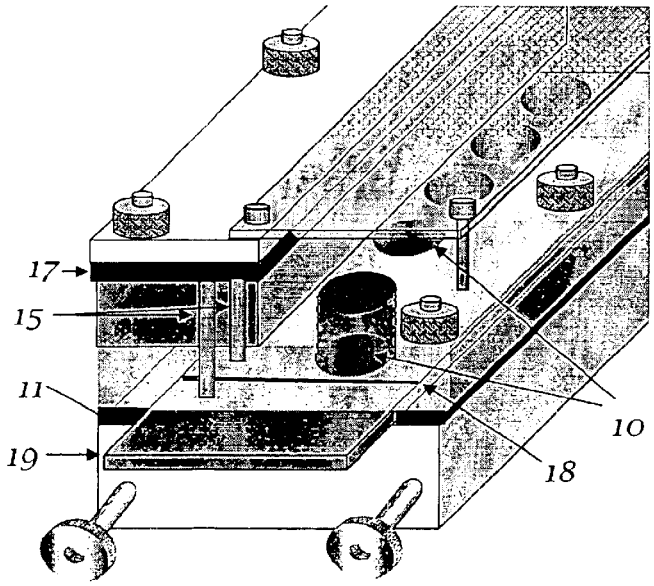
Figure 3C:
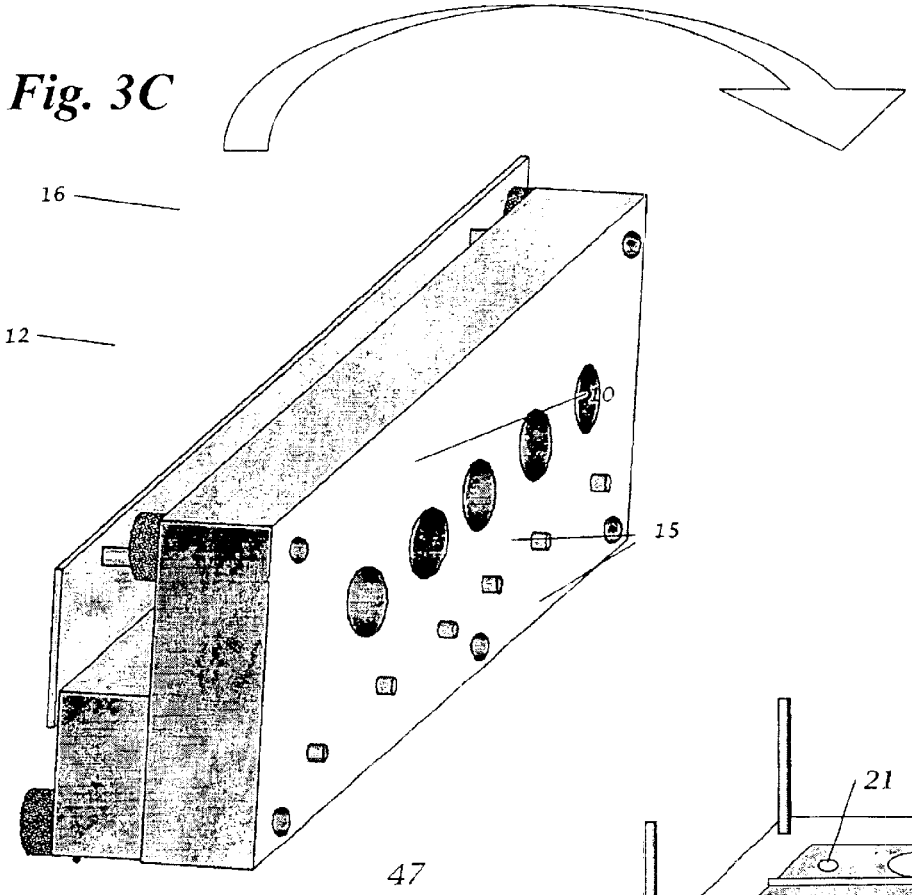
Figure 3D:
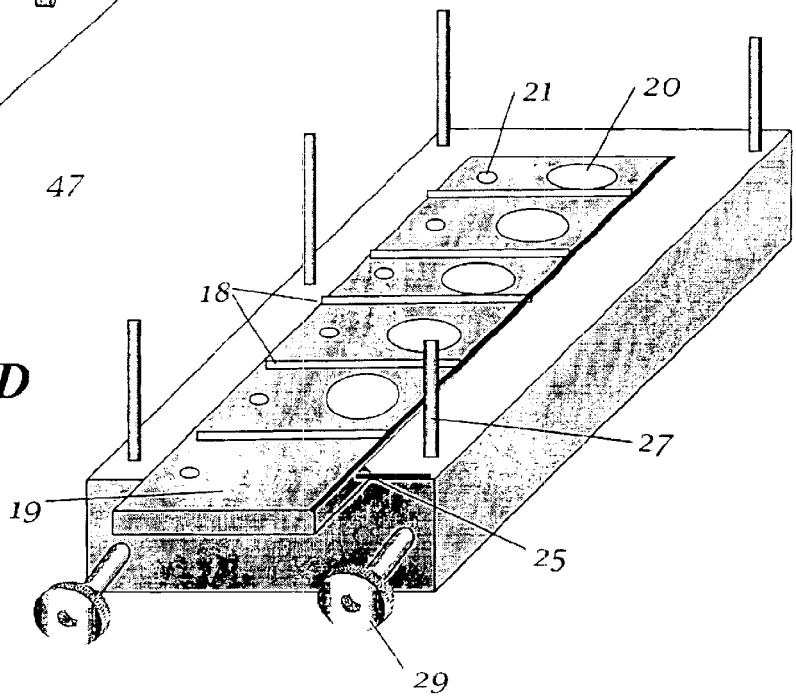
Figure 3E:
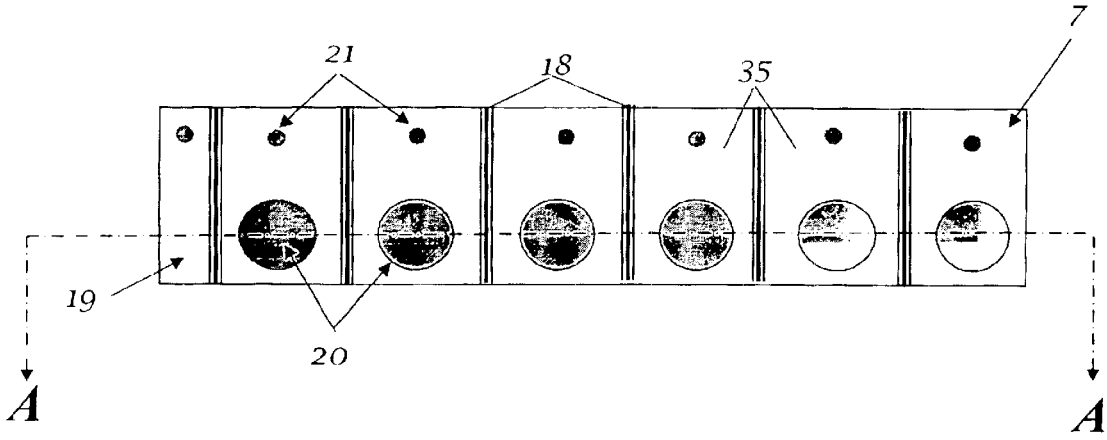
Figure 3E:
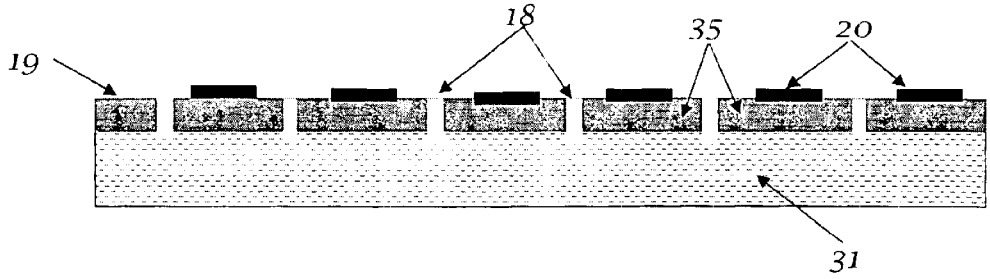
Figure 3G:
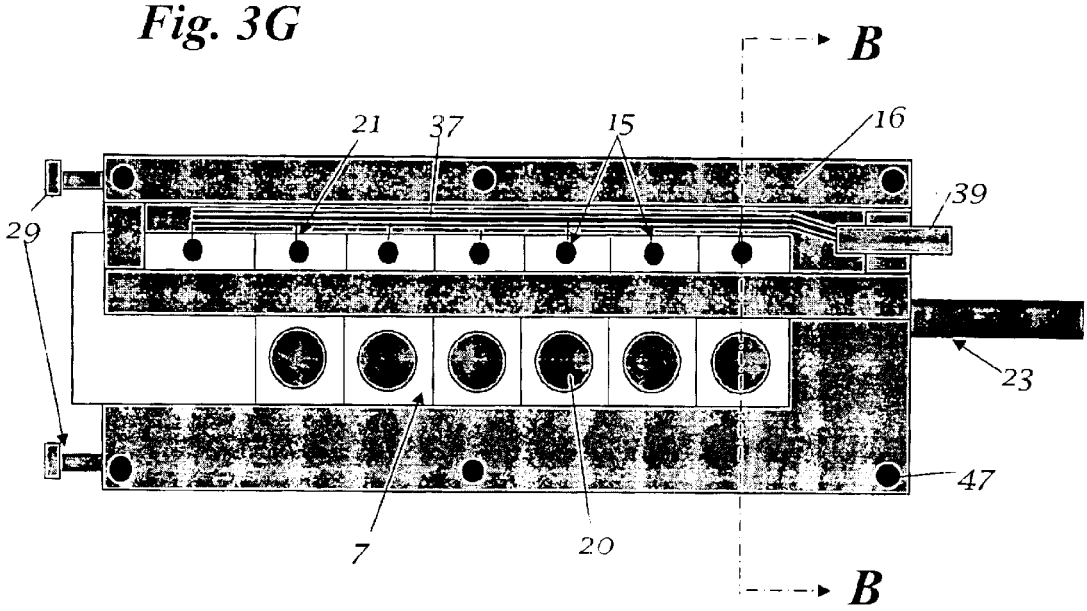
Figure 3G:
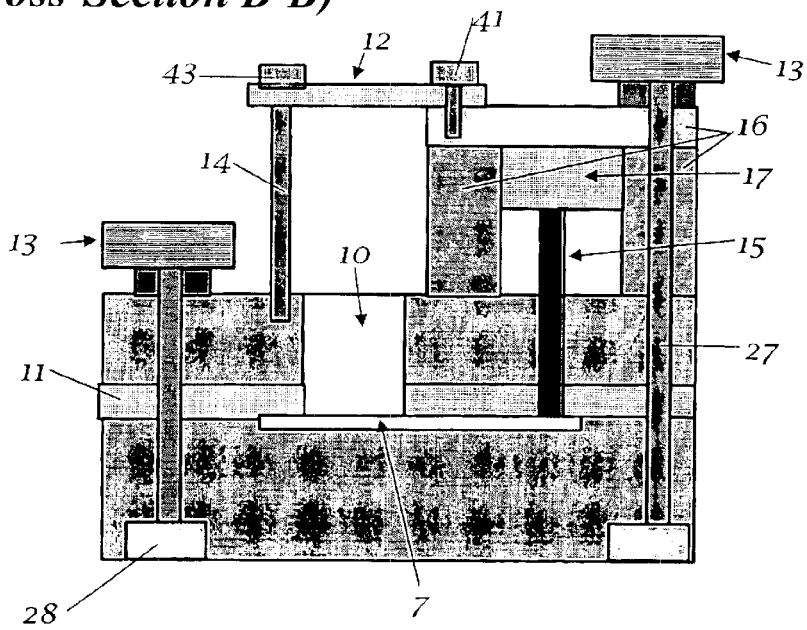
Figure 4:
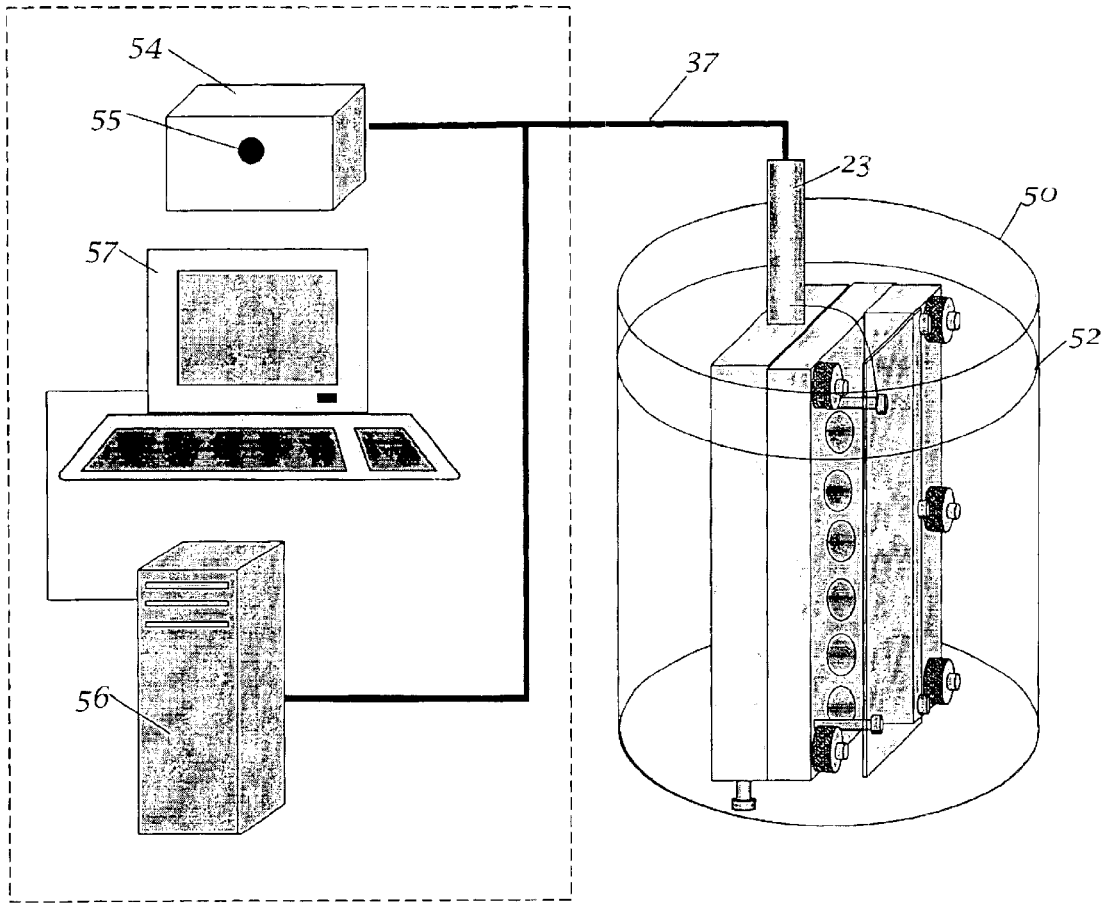
Figure 5A:
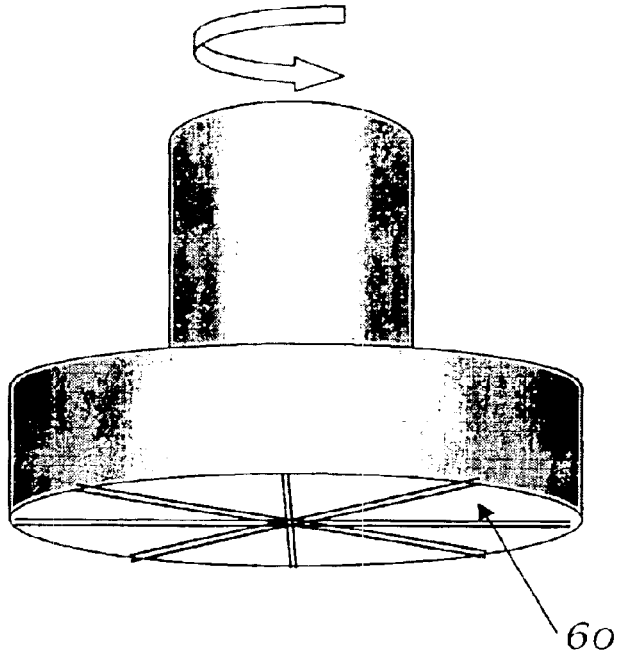
Figure 5B:
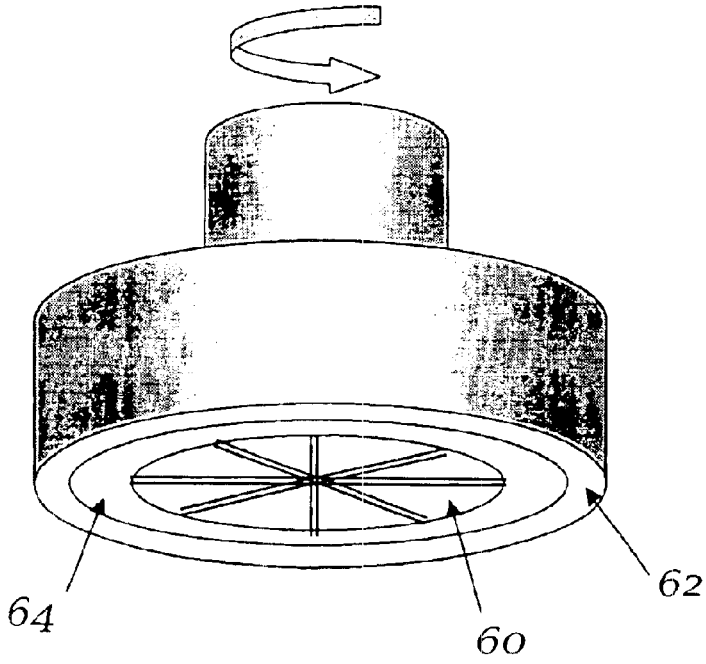
Figure 6A:
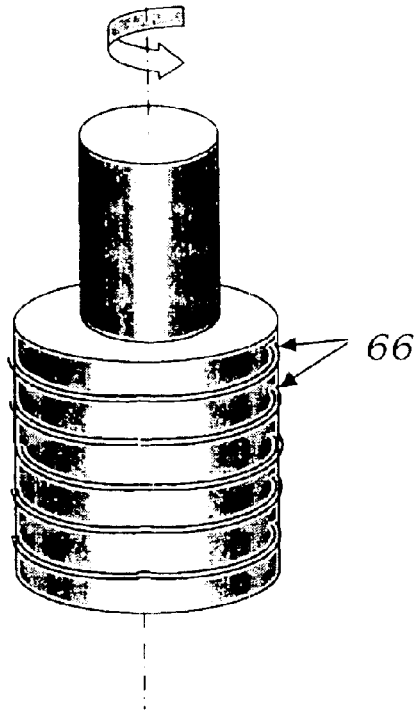
Figure 6B:
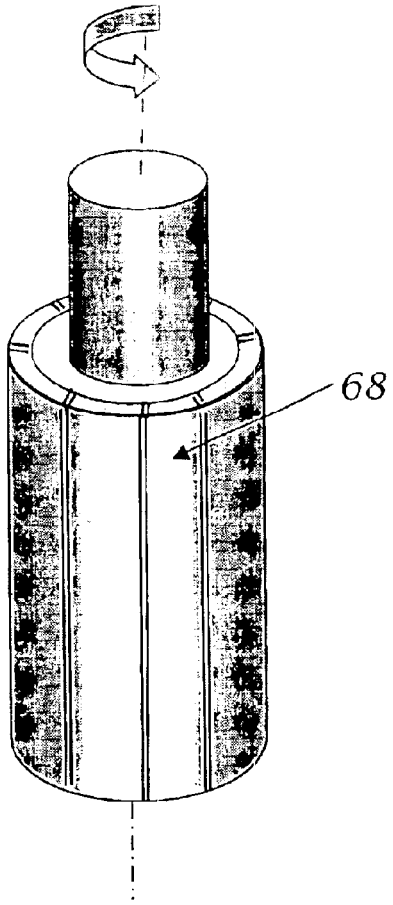
Figure 7:
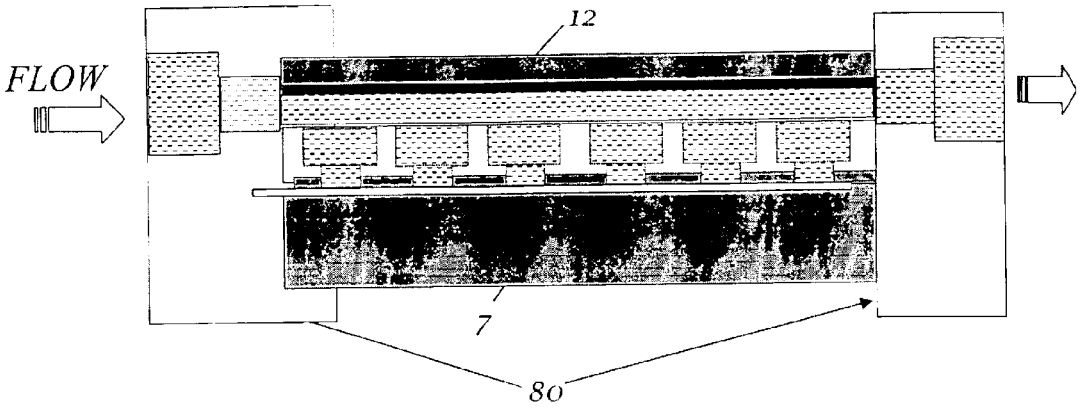
Figure 8:
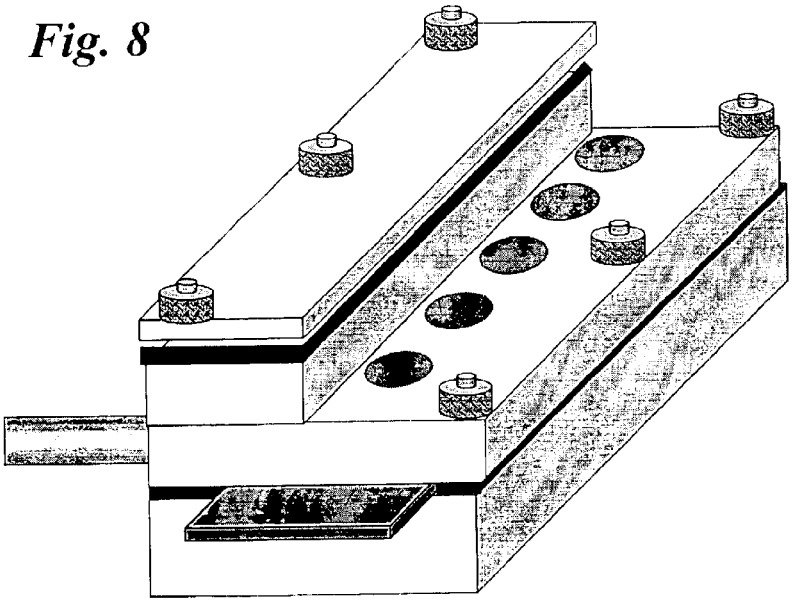
Figure 9A:
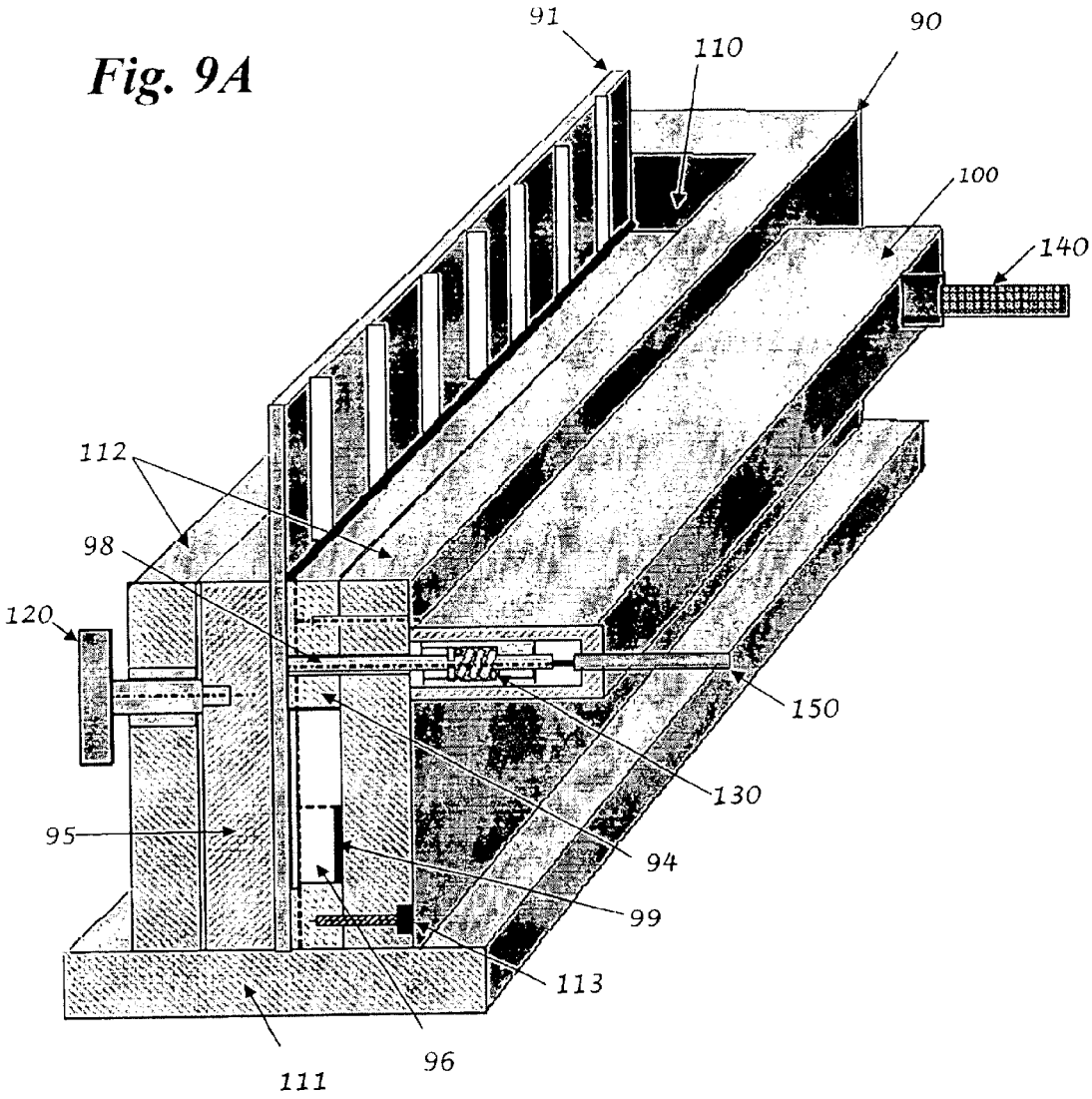
Figure 9B:
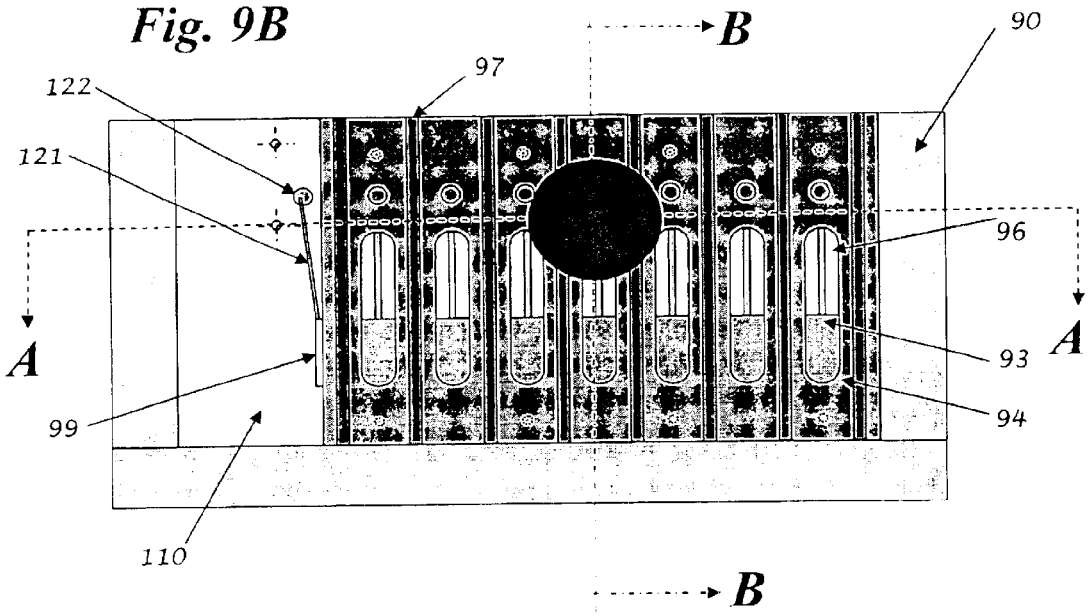
Figure 9B:
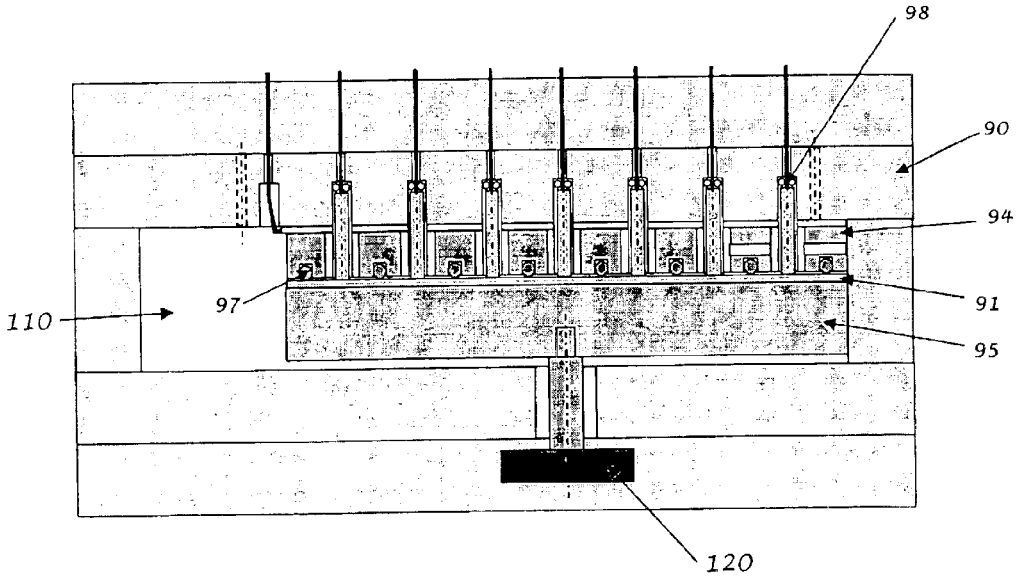
Figure 9F:
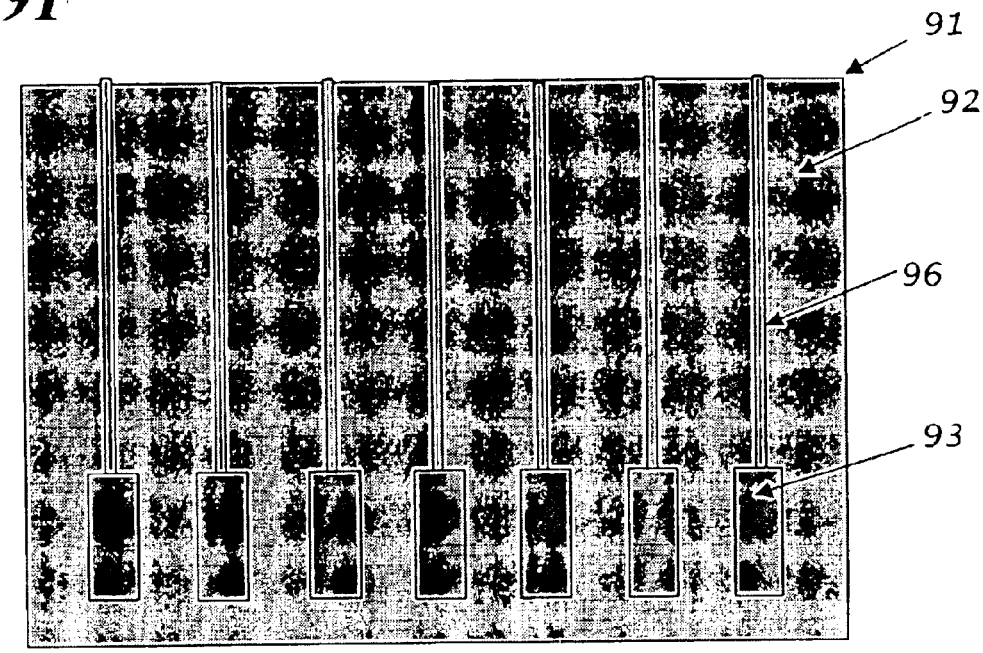

The structure, operation, and advantages of the present preferred embodiment of the invention will become further apparent upon consideration of the following description taken in conjunction with the accompanying drawings, wherein:

FIG. 1A is a prior art prismatic Hull-cell;

FIG. 1B is a card on which the expected current density is indicated as a function of position for a prior art Hull cell;

FIG. 2 is a graph showing the curves of the computed current density distributions in typical electrolytes;

FIG. 3A is an orthogonal view of an embodiment of a cell device consisting of an electrode substrate with multiple electrode segments, according to the present invention;

FIG. 3B is a partially transparent view of the device showing some internal features of the cell device according to the present invention;

FIG. 3C is an orthogonal view of a cover of the cell device of FIG. 3A according to the present invention;

FIG. 3D is an orthogonal view of the base the cell device of FIG. 3A according to the present invention;

FIG. 3E is a front view of the plated substrate shown in FIG. 3D;

FIG. 3F is a cross sectional view through line A—A of FIG. 3E showing the plated substrate;

FIG. 3G is a top view of the cell device of FIG. 3A, showing the projections of the key cell components;

FIG. 3H is a cross sectional view through line B—B of FIG. 3G;

FIG. 4 is a schematic view of the cell device of FIG. 3A immersed in a beaker according to the present invention;

FIG. 5A is an orthogonal schematic view of a segmented rotating disk electrode according to another embodiment of the invention;

FIG. 5B is an orthogonal schematic view of a rotating segmented disk electrode surrounded by a ring electrode according to another embodiment of the invention;

FIG. 6A is an orthogonal view of the cell device configured as a cylinder according to another embodiment of the invention;

FIG. 6B is an orthogonal view of the cell device configured as a cylinder according to another embodiment of the invention;

FIG. 7 is a side view of a cell device configured as part of a flow channel, according to another embodiment of the invention;

FIG. 8 is an orthogonal view of a cell device without an anode according to another embodiment of the invention;

FIG. 9A is a diagonal view, showing a cross-section with some key internal features of a cell device designed to function as a tabletop instrument according to another embodiment of the invention;

FIG. 9B is a partially transparent side view showing some key components of the tabletop cell device of FIG. 9A;

FIG. 9C is a cross sectional top view through line A—A of FIG. 9B showing some of the components;

FIG. 9D is a cross sectional front view through line B—B of FIG. 9B showing some of the components;

FIG. 9E is a front view of the plating mask shown in FIG. 9A;

FIG. 9F a front view of the plated test panel shown in FIG. 9A;

DETAILED DESCRIPTION OF A PREFERRED EMBODIMENT

The present invention generally relates to a device consisting of an electrode substrate with multiple electrode segments. The device is immersed in an electrolyte and the current turned on for a period that can range from, typically, a few seconds to many minutes. The different currents to each of the electrodes or electrode segments are measured, and provide, after computations, the process parameters detailed above. The invention also teaches a simple method for setting the different controlled segmental currents, although other methods may be used as well, for obtaining similar current ranges. To increase the range of measurements, different voltages or currents can be sequentially applied. The invention further discloses a method that enables the utilization of said currents to yield quantitative data characterizing the electrochemical process. In a preferred embodiment, the invention comprises a special fixture that holds a segmented electrode substrate (here, the cathode), exposing to the electrolyte well-defined regions on said electrode. The device further incorporates multiple terminal contacts, typically, one to each segment, that are adjusted to deliver and measure a different current density to each segment. The invention also discloses a special computational approach to determine from said measured segmental currents, critical electrochemical process parameters including the polarization curve and its associated kinetics constants, the electrolyte conductivity and the equilibrium potential.

Typically, the device is designed, by selecting the configuration and dimensions of the cavities through which the electrode segments are exposed to the electrolyte, such that the current density and therefore also the deposit properties within each of the distinct regions is relatively uniform. Although this uniformity is not a requirement for the disclosed device (and in certain applications a non-uniform distribution may be advantageous), typically this design for uniformity is an advantage. One means of achieving uniformity is by having relatively high-aspect ratio holes, e.g. ratio of depth to diameter of the order of 1 or more.

An important parameter for electrochemical process analysis, and particularly for plating, is the current efficiency, i.e. the fraction of the passed current that contributes to the actual deposit. This current efficiency typically varies with the prevailing current density. The determination of the current efficiency can be made by comparing the precisely measured segmental currents to measurements of the corresponding deposit thickness or weight on the different plated 'patches'.

Further understanding of the present invention will be had with reference to the following examples, which are set forth herein for purposes of illustration but not limitation.

EXAMPLE 1

FIG. 3A is a schematic drawing of a device that incorporates facets of the invention disclosed herein. FIG. 3A shows an overall view, FIG. 3B is a partially transparent view of the device showing some internal features of the cell. FIG. 3C shows the cover of the cell in an upside-down view, revealing the separate contacts and the cavities. FIG. 3D is a view of the bottom part of the cell with the top removed, showing the plated segmented substrate. FIG. 3E shows a schematic top view of the plated segmented cathode, and FIG. 3F is a cross-section (not to scale) of same substrate. FIGS. 3G and 3H are cross-sections of the device. The specific device described herein is about 2 inches wide, 5 inches long and about 1.5 inches high. It is understood that different sizes may be applied. Following is a detailed description of the device.

The device consists of two major parts as shown in detail in FIGS. 3C and 3D: a base (8) shown in detail in FIG. 3D, and a cover (9), shown in detail in FIG. 3C. The base and cover are both made of a rigid insulating material, e.g., a ceramic or a plastic, and in this particular embodiment, polyvinyl chloride (PVC). Other materials that can be used include, among others, Plexiglas, epoxy, and Teflon. A conducting material can also be used, however, in this case it must be coated with an insulating film. The base incorporates a slot (25) that helps position the plated segmented substrate (7), as shown in FIG. 3D. This slot is not an essential part of the example and is provided for convenience in positioning the plated substrate. Other guides, made e.g., of an elastomeric or a rigid plastic frame can replace it. As shown in FIG. 3D, the base also incorporates threaded posts (27) that provide positioning and tightening of the cover, (9), using the knurled nuts (13) that are shown in FIG. 3A. The base also incorporates, optionally, bumpers (29) at its front to protect the protruding portion of the plated substrate.

An insulated substrate (7) coated with a thin and segmented conductive seed layer has is clamped between the base (8) and the cover (9), as shown in FIGS. 3A, 3B and 3D. The plated substrate is shown schematically in FIGS. 3E (top view) and 3F (cross section). In order to illustrate details, these drawings are not to scale. A typical size of the substrate is about 1.5" wide and about 3.5" long, although other sizes may be used. The substrate thickness is not very important and may vary, however 1/16" may provide a typical value. The substrate bulk (31) in FIG. 3F, may be made of any of a variety of electrically insulating (dielectric) materials. An example is silicon, glass or a plastic material such as used in printed circuit boards, e.g., polyimide. The conductive seed layer on top of the insulating substrate (35) may consist of e.g., copper, nickel, brass, gold, or any other conductive layer that is compatible with the electrochemical process to be tested. The thickness of the said layer range from very thin e.g., 500 Angstrom to a mm or more. However, the minimal thickness must be such that it provides a continuous conductive layer. Metallic layers below about 100 Angstroms are known to agglomerate, which is not desirable. The conductive seed may be deposited on the substrate using, most commonly, a vapor phase process (e.g., evaporation, physical vapor deposition, chemical vapor deposition), an electroless process, or by lamination or gluing of a conductive film onto the dielectric substrate. Said seed layer in the present example is segmented, i.e., consists of electrically isolated sections (35). Separating grooves to isolate the segments are indicated by (18) and shown in FIGS. 3B, 3E and 3F. It should be noted that instead of the insulating substrate coated with isolated electrode segments, completely separate electrode sections may be used. Such separated electrodes may either consist of seed covered insulating substrate or be made entirely out of conductive material, such as copper, brass, or zinc. However, such separate electrodes may not be as easy to handle and position as the one piece segmented substrate, and therefore are less desirable. Cavities within the cover (9) define the plated regions, typically circles (20) shown in FIGS. 3D, 3E and in the cross-section 3F. Also indicated faintly in FIGS. 3D and 3E are the points of electrical contacts with each segment (21). As shown in FIGS. 3B, 3D, 3E and 3F, the front edge of the cathode consists of an un-plated but electrically contacted segment (19) that serves as a reference electrode. Its role is discussed further below.

The device cover (9), which can be made of the same or different material as the base plate (8), incorporates cavities (10) that define the areas through which the cathode segments are exposed to the electrolyte and to the ionic current. An elastomeric (e.g., rubber) gasket (11) between the base and the cover may be beneficial in providing a good seal around the cavities and accurately define the circumference of the plated 'patches' on the seeded substrate. The cavities shown here are of a round cross-section, however, other configurations, including squares and rectangles can be contemplated. The size of the plated 'patches' is not critical, however, some minimal size of e.g., a few mm in diameter or length, is beneficial in order to facilitate visual inspection, if so desired. In the specific example discussed here, holes with a diameter of about 3/8" and a depth of about 7/16" were selected. The depth of the cavities ensures a uniform current density across the exposed regions on each of the segments. Furthermore, the depth of the cavity also controls the mass-transport. For short deposition experiments, e.g., a few minutes, where depletion of the electrolyte within the cavity is not significant, the depth of the cavity beyond some minimal value, equivalent e.g., to the diameter of the hole, to assure uniform current distribution and provide a sufficient electrolyte reservoir, is not critical. However, for longer deposition experiments, or for experiments where mass-transport effects are studied, the depth of the cavity must be properly designed and accounted for in the model. An array of thin rods, (15), placed inside an insulating compartment (16) that is attached to the top of the cover (9), penetrate through the bottom of the cover as shown in FIG. 3C and make contact with the metallic seed layer to be plated. These rod contacts provide a separate current feed to each of the segments. Their point of contact with the plated substrate is indicated by the faint circles (21). The contacts can be made from a variety of metals or alloys. Examples include, copper, stainless steel, titanium or their alloys. To ensure a low contact resistance, the contact points may be optionally coated with platinum or gold. The contacts may be pressed against the cathode using a spring or a compressible pad made of e.g., elastomer, indicated by (17) in FIGS. 3A and 3B. The role of the sealed compartment (17) is to support the contact rods and provide of a region that is not exposed to the electrolyte. Within that region, the electrical feed wires, (21), shown in FIG. 3G, are connected to the top portion of the rod contacts. The electrical wire bundle (37) is fed through a sealed wire feed (39) into the compartment. The compartment (16) also supports the back portion of the anode (12) that is attached to it by small screws (41) as shown in FIGS. 3A, 3B, and in the cross-section 3H.

The counter electrode, which is not segmented, is in this example the anode (12). It may be a plate, perforated plate, or an expanded mesh, fixed at some distance away from the cathode. The anode can be made of a number of conductors on which oxygen can evolve including: platinum, gold, titanium, titanium coated with iridium oxide or ruthenium oxide or platinum, lead, or silver-lead alloy. Alternatively, soluble anodes made of e.g., copper or nickel, as appropriate for the tested electrolyte, may be used. A wire (42) in FIG. 3A provides the current to the anode. The anode is supported in the configuration of this example in its front end by stand-off insulating rods (14), to which the anode is fastened by means of a small screw (43). As discussed below, a variant of the present example, where an anode is not incorporated in the device can be equivalently contemplated. In the case, externally provided anodes may be used. Typically, in this latter situation, deeper, narrower cavities may be desirable, to minimize the variability in the electrolyte resistance associated with different distances between the cathode and the external anode that can be exercised in different experiments.

The different current through each contact (and cathode segment) is set using special electronics circuit. The latter may consist of a number of separate potentiostats or current limited power supplies. A likely preferred embodiment is using a single power supply, but incorporating an array of operational amplifiers, voltage followers, or as incorporated in the present example, a number of current controlling resistors. If these external resistors are much larger than any other resistance in the current path, i.e. much larger than the electrolyte resistance, the resistance attributed to the electrode reactions (on both the anode and the cathode), and any mass transport resistance, then the current within any cathode segment will be controlled by this external resistor. Furthermore, measuring the voltage drop across this resistor provides a measure of the current in the given branch. In some applications, it may be desirable to replace this one controlling resistor, by two resistors, where one may be a relatively small shunt, across which the segmental current can be determined by measuring the voltage drop.

As noted in FIGS. 3A, 3B, 3D, 3E, and 3F, a section of the substrate (19), covered by an electrically isolated seed layer extends beyond the substrate holder. This extension serves the dual purpose of aiding in inserting and removing the cathode, and also serves as a reference electrode. Accordingly, this extension is connected to the voltage-sensing device through a high impedance resistance so that no appreciable current flows through this segment and thus it is not plated. Obviously, other configurations of the reference electrode are possible. Lastly, bolts (27), or other clamping hardware is used to tightly clamp the cathode between the fixture bottom plate and cover. Holes in the cover, (47), provide clearance for the bolts. Knurled nuts (13) are used to tighten the fixture together.

FIG. 3G provides a top view of a cross-section through the device. The electrical connections (21) to the separate contacts (15), are shown. Also shown are optional pegs (29) to protect the protruding edge of the substrate that can serve as a reference electrode, and a handle (23). The cross-sectional side-view in FIG. 3E shows details of the clamping bolts (27), the anode (12), the plated cavity (10), and the contact (15), pressed by the elastomer (17) against the cathode (7). Lastly, sink nuts (28), at the bottom of the base provide support to the threaded rods (27).

The device as shown schematically (not to scale) in FIG. 4 is immersed in a beaker (50) containing a sample of the electrolyte to be tested, or immersed in an industrial scale plating cell. The volume of the electrolyte to be tested is not critical; however, the electrolyte level (52) must be sufficiently high to cover all the cavities through which plating is to be done. A 200 ml beaker is typically adequate. The power supply (54) is turned on [by pressing switch (55)] for a few seconds or minutes during which electrochemical reaction takes place, the deposit builds-up (at different rates) on the exposed areas of the cathode, and the data acquisition records the segmental currents and voltages. The data acquisition can be computer-based, as shown (56) in FIG. 4. From the recorded data, the polarization curve (i.e., a plot of segmental current densities vs. the overpotential) is constructed. In addition, the electrolyte conductivity is determined, and the equilibrium potential established. The data is stored in the computer and can be displayed on the computer screen (57). The computations are based on conducting voltage balances between each of the different cathodic segments, the reference electrode, and the anode. The segmental voltage balance equations equate the voltage drop across the controlling resistances, when present, the cathodic standard potential, the activation resistance associated with the cathodic electrochemical reaction, the ohmic resistance in the electrolyte, the standard potential at the anode and the overpotentials at the anode to the externally applied voltage by the power supply. All those parameters, with the exception of the standard potentials, depend either linearly or non-linearly on the current density, which is controlled and measured independently in each of the segments. The set of voltage balance equations can be solved simultaneously to yield the electrochemical process parameters listed above. The computations hinge on Cell-Design's computer implemented modeling of the cell, to provide the appropriate electrolyte resistances that are used in the computation. However, the invention herein can also work remotely of Cell-Design software, where said constants are separately evaluated. Alternatively, empirical calibration of the cell herein, using well-characterized electrolyte, for which all the parameters are known, is possible. In this case, the computer-based model is no longer required.

A computer program computes the needed parameters ($i_0$, $\alpha_A$, $\alpha_C$, $\kappa$, $E^0$) from the recorded data. The computed parameters and the polarization curve are stored in a computer and can be displayed graphically and numerically. They can also be incorporated in a database linked to electrochemical computer-aided-design software used for modeling electrochemical systems with the same electrolyte but a different configuration.

The beaker (50) into which the test fixture is immersed may be optionally equipped with an immersion heater (not shown), or placed on a hot plate (not shown) to control its temperature. Agitation through a magnetic stirrer, bubble induced agitation using inert gas, or air sparged from e.g., a fritted glass, or convective flow using a pump may also be applied.

EXAMPLE 2

Another cell and electrode configuration that can be used advantageously when incorporating elements of the invention disclosed herein, is a segmented rotating disk electrode (RDE), as shown schematically (60) in FIG. 5A, or a rotating segmented disk electrode surrounded by a ring electrode (62), as shown schematically in FIG. 5B. An insulating ring (64) separates the two. The ring electrode may serve as the reference electrode, a co-planar anode, or another auxiliary electrode whose potential is scanned and is used for analyzing products or reactants of the electrochemical reaction [Ref. 5]. The segments can be pie-shaped at the bottom of the rotating shaft (60), as shown in FIG. 5A. This configuration works similarly to that discussed in example 1, however, it can provide also additional transport data. As shown by Levich [Ref. 6], the rotating disk provides a uniform and easily calculable boundary layer thickness (or mass transport coefficient) that depends on the inverse square root of the rotational speed. By measuring the parameters listed above (e.g., the kinetics parameters, at different rotation speeds, the effect of transport on the kinetics parameters can be determined, and the diffusivity can be evaluated.

EXAMPLE 3

The device disclosed herein can also be configured as a cylinder, as shown schematically in FIG. 6A and FIG. 6B. This configuration can be used similarly to the ones discussed above e.g., Example 1. It has, however, a number of advantages: it can be rotated to incorporate the effects of transport, as in example 2, it can be designed in a compact form, to be used with small volumes, and furthermore, if configured as a very small diameter, it can present low transport resistance, since the radial diffusion flux is inversely proportional to the radius. Because of the electrode curvature, it can account for and simulate the effect of curvature on the deposit, e.g., incorporate effects of curvature on stress, and adhesion. The latter may be particularly important, because often deposits that show marginal adhesion to a flat substrate may adhere satisfactorily to a curved one. The segmental electrodes (66) can be stacked one on top of the other as shown in FIG. 6A or the cylinder can be segmented radially (68), as shown in FIG. 6B. Other configurations that involve bodies of revolution, e.g., cones, spheres, etc, can also be contemplated.

EXAMPLE 4

A variant of the fixtures described as examples 2 and 3 is a configuration whereby the central circular electrode, which can be either a disk or a cylinder, is not segmented, however, the surrounding electrode, which may be either the anode or the cathode, is segmented, and provides the multiplicity of electrodes claimed herein, that are discussed in detail in example 1. By controlling the current density on the different surrounding segments similar results to those described in detail in example 1 can be obtained for the surrounding segmented electrodes.

EXAMPLE 5

The device disclosed herein, can also be configured as part of a flow channel, as shown schematically in FIG. 7. Here, a cell with the segmented electrode (7) is incorporated with, or inserted into a flow channel through which the electrolyte is circulated. The measurements can then be made at one or more flow rates. The advantage of this configuration is that convective electrolyte flow can be adjusted to simulate conditions in the actual processing cell, and also, the data can be evaluated at different flow rates so that the effect of flow on the other process parameters can be quantified. Additionally, the diffusion coefficient of the reacting species can be evaluated. In one embodiment, the fixture described in example 1 is inserted into a 'manifold' (80) that is incorporated within a flow loop, consisting of a circulation pump, an electrolyte holding vessel, a flow-meter and a valve for adjusting the flow (not shown). In the flow channel configuration the anode (12) can be part of the measurement cell fixture, as in example 1, or it can be part of the flow channel, embedded in its wall. A similar flow circuit can be incorporated in other device configurations, e.g., the base and mask of example 11 (FIG. 9) can be similarly modified to incorporate flow.

EXAMPLE 6

A variation of the cell described in example 1 can be contemplated, where the anode, [(12) in FIG. 3], is not incorporated in the fixture. Instead, the fixture (without the anode), schematically shown in FIG. 8, can be immersed in a production-type cell, or in a test cell, that incorporate their own anodes. In this case, the test fixture can be connected to the existing anode through its own power supply, or use an existing power supply that may already be connected to an existing a node. The advantage of this embodiment of the invention is that the testing and analysis can take place in the actual production environment, under actual process conditions, eliminating the need to transfer electrolyte sample to a test beaker. The electrolyte characterized this way resembles more closely the actual process conditions.

EXAMPLE 7

This example describes a configuration where the multiplicity of electrode segments are not necessarily located on a specific geometric configuration such as a plane substrate (example 1) a disk (example 2) or a cylinder (example 3). Here we bring forth the general notion that each of the multiplicity of the controlled electrode segments can be separately placed in any arbitrary location within a test fixture, a test cell or even a production cell. As long as the location of the electrode is specified and it does not vary in an uncontrolled manner during the experiment, its current is well controlled and measurable, and its current density is different than that on a number of the other electrodes, a voltage balance can be carried out for each electrode. From this voltage balance, the polarization curve can be constructed and the process parameters listed in the summary section and example 1 above can be computed in the same manner as described under example 1 above. Additionally, samples produced under different and precisely determined current density can be made available for visual inspection. The separate segments may consist of differently configured separate electrodes. However, for accuracy, it is important that each electrode be designed to experience a relatively uniform current density over its area. This can be achieved by e.g. embedding each electrode in an insulating well, such as that used in the configuration discussed in example 1. Another possibility is to use electrode segments that provide uniform current density. These may consist of spherical electrodes, hemispherical electrodes, or cylindrical segments. In those configurations, the counter electrode (e.g., the anode) must be placed far away from the electrode segment on which the current density is being measured. 'Far away' here means about 3–5 diameters or more away from the measured electrode. Alternatively, the counter electrode may be placed closer; however, it must then be of the same geometrical configuration as the tested electrode. This implies that when placed in close proximity, a cylindrical counter electrode must surround a cylindrical controlled electrode, and a spherical counter electrode must surround a spherical controlled electrode.

EXAMPLE 8

Example 8 refers to situations where differently shaped or sized electrodes may be applied advantageously. An example is the situation where it is desired to apply the same overall current to each electrode segment while it is needed for the invention disclosed herein to have different current densities on each segment. Since the current density is determined by the ratio of the total current to the electrode area, different current density may be achieved by varying the electrode area while maintaining the same total current. The rational for the desirability of feeding each segment with the same total current is that it may be easier to electrically to generate such a condition, and once such equal total currents are maintained the segmental currents may not require individual measurements, simplifying the data acquisition task. In this application, segmental electrode areas are sequentially increased to provide a decreasing sequence of current densities. Care must be paid to assure current density uniformity across the electrodes, requiring a deeper insulating cavity.

Another means of obtaining different and well-controlled current density on different segment without controlling this distribution by electrical means is through the design of a cell that provides a non-uniform current distribution. Such design can be based on a slanted or a curved anode, or an electrode that forms different angles with the sidewalls, similar to the Hull cell. However, here, unlike e.g., the Hull cell, we apply a segmented electrode and measure precisely the current density on each segment. This provides

EXAMPLE 9

This example discusses the application of the invention disclosed herein to electrochemical processes involving multiple simultaneous electrode reactions. One, particularly important embodiment of this class of processes is that of alloy plating. Here, multiple species, typically, but not always, metal ions, are reacted simultaneously from a mixture in a common electrolyte to provide a deposit that consists of multi-constituents that typically form an alloy, a solid solution, or a solid mixture. Specific examples of industrial interest include, but are not limited to, brass (copper-zinc alloy), perm alloy and other compositions of iron-nickel, tin-nickel, tin-palladium, tin-gold, solder and other composition of tin-lead, nickel-zinc, among many others. This example applies also to systems where one component may be a minor constituent of the deposit, for example, when doping compounds or trace elements are used to impart to the deposit special properties. Examples include, gold-cobalt and gold-nickel. Other examples of common multiple simultaneous electrode reactions are manifested when plating additives are used to provide special properties to the deposition process itself. Here often organic compounds, but occasionally, inorganic or metallic trace compounds are added to the electrolyte to affect the deposit color (e.g., nickel in gold, or chloride in copper), surface texture, (e.g., sulfur compounds ('additives') in copper plating), or level the deposit distribution (e.g., polyethylene glycol ('carrier') in copper plating or sodium lignin sulfonate in lead plating). In all those cases, and in particular in the alloy plating applications, it is very difficult to determine the kinetics parameters of the different but simultaneous electrode reactions. The reason being, that the codeposition process incorporates interactions between the different participating species, which no longer behave as if they were undergoing the electrode reaction just by themselves. These interactions are often quite significant, and in numerous situations, modify completely the expected results. An example is perm alloy (iron-nickel) plating, where the nickel plates much more readily than the iron, however, based on the single metal experiments, the iron should plate preferentially. Accordingly, single species deposition experiments are useless in providing data for the alloy deposition process. On the other hand, studying the deposition rates of the components during co-deposition is difficult, because only the total current can be measured, and the latter is not species-specific. Hence, one needs in addition to analyze the deposit composition and deduce from the latter, the partial currents for the deposition of each component. By itself this is not a very difficult procedure if the required analytical instrumentation is available. However, since the partial currents are needed as a function of the complete current or voltage range which the process might experience, direct scanning is no longer an option, and a series of separate deposition experiments is required to produce samples that span the entire range of interest. The invention disclosed herein, eliminates the need for a series of experiments and provides, all at once, a number of samples (corresponding to the different segmented controlled electrodes), where each has been plated at a single different current density. Once compositional analysis of the different patches is performed, the partial kinetics parameters, evaluated under interactive conditions, can be readily calculated, following the procedures outlined in example 1 for a single electrode reaction.

EXAMPLE 10

In the foregoing examples, the different current densities were generated by electrical means, i.e., electrical circuitry controlled the current distribution. However, the cell configuration is another means that can be used advantageously to generate a varying current distribution. Unlike earlier disclosures, by e.g., Hull [U.S. Pat. No. 2,149,344], we provide, however, precise means, using the segmented electrode approach, to measure the local current density, and use this to correlate both the appearance of the deposit to the current distribution and to quantitatively evaluate the process parameters. Methods that can be used to generate a varying current density along a prurality of isolated electrodes, which are contemplated in the present example, include the use of a slanted or curved anode, a cell with varying electrolyte gap, and resistive electrodes. The latter can be used either as anodes or cathodes, to produce a non-uniform current distribution.

EXAMPLE 11

Another manifestation of the invention, shown in a schematic diagonal cross-sectional view in FIG. 9A, is a tabletop device. The tabletop unit consists of four major parts: a container vessel (90), a patterned shielding mask (94), a test panel (91), and the electrical connector assembly (100). FIG. 9B shows a side view of the device, with partially transparent walls to show some key internal features. FIG. 9C is a top view of a cross-section through the device as indicated by the dashed line A—A in FIG. 9B. FIG. 9D is a frontal view of the device through the cross-section indicated by the dashed line B—B in FIG. 9B. FIG. 9E is a side view of the plating mask that is indicated by (94) in FIG. 9A. FIG. 9F is a side view of the test panel that is indicated by (91) in FIG. 9A. A more detailed description of the device follows.

The function of the container (90) is to provide space (110) for containing the tested electrolyte and to hold the device components in place. The container, which is made from an electrically insulating rigid material, e.g. cross-linked polyvinyl chloride (CPVC), consists of a base plate (111), and four vertical side-walls (112) forming a rectangular box that measures in this particular example about 1 inch in width (depth), 6 inches in length and 3 inches in height. Typically, the container is larger in length than the plated panel, thus providing a non-occupied region (110) into which the tested electrolyte can be easily poured. In this particular example, no cover is provided for the container, although an optional cover may be incorporated as described below.

The patterned mask (94 and FIG. 9E), consisting of an insulating plate, in this example, ⅜" thick CPVC, with a slot pattern (96) cut into it. The mask is placed inside the container and is mounted against its back wall using bolts (113). The slots expose predetermined regions of the metal pattern on the test panel (91) to the electrolyte. The function of the mask is to restrict the plating current to certain, precisely determined regions on the test panel. Optional gaskets (97) can be used to separate the compartments formed by the mask to minimize or eliminate current leakage and 'cross-talk' between the electrode segments. Modeling and experiments indicate, however, that this 'cross-talk' is negligible, and the gaskets can be eliminated without loss of noticeable accuracy.

An anode (99), which is a sheet metal, perforated metal, or a metal grid or mesh, made of e.g., titanium, platinum, platinized titanium, gold, ruthenium, or stainless steel, is facing the exposed segments of the test panel. The anode is placed inside a groove on the back side of the mask and clamped between the mask and the sidewall. The anode is connected via a non-dissolving conductor wire indicated as (121) in FIG. 9B, which is made of e.g., platinum, titanium or tantalum, and connected to a terminal (122) on the electrical connector (100).

The test panel (91, and FIG. 9F) is typically a customized printed circuit board, consisting of an insulating substrate (92, FIG. 9F) onto which a conductive metal stripe pattern (93, 96, in FIG. 9F) is printed or etched. The lower, broader pads of the pattern (93) get plated; the upper, narrower stripes (96) provide means for feeding the current to the plated pads. Since the stripes are narrow, any portion thereof that is not masked and gets plated will not introduce a large error in terms of the measured current and the computed current density (=current per plated area). One or more pads, typically at the front end or the back end of the electrode array, may not be plated and used instead for sensing purposes, as a reference or sensing electrodes, providing a measurement of the electrolyte conductivity and/or the standard potential of the plated metal. In this particular example, one pad out of seven, located at the front end of the pad assembly, is used as a reference electrode. The metal pattern is typically made of copper. For characterizing the plating of metals other than copper, the copper pattern may be optionally pre-plated with other metals, matching the type of plating solution to be tested. For example, in testing of nickel plating solutions, a nickel coating may be pre-applied onto the copper, or any other base metal, prior to testing. This, however, is not essential, because the substrate metal becomes coated with the plated metal during the test itself. The pre-coated substrates may improve, however, the accuracy of the test.

The test panel (91) is inserted prior to the test into the container (90) and pressed against the insulating mask (94) by a back-plate (95) made of a rigid insulating material, e.g., PVC, which is pushed and held in place using a screw (120) or a toggle clamp.

The electrical connector assembly (100) provides means for feeding the plating current separately to each of the plated segments, and the sensing voltage to the sensing or reference electrodes, when used. The electrical connector assembly consists of a multiplicity of metallic rod contacts (98) that are pressed against the metal stripes on the test panel by means of springs (130), such that a separate rod makes contact with each of the metal stripes, feeding the current to the plated pads. Instead of springs, an elastomer strip may be applied at the back of the rods and provide the required contact force. The current from the anode is also fed through the electrical connector assembly. In this particular example, the anode current is fed through the mounting bolt (140) of the connector assembly. This bolt screws into a nut (122) in the container sidewall that is connected to the anode wire (121). A multi-conductor cable (150) or ribbon feeds the currents from the connector assembly through different magnitude resistors to the power supply that is located within the main electrical box (not shown). Once voltage is applied, a different magnitude current is fed to each of the contacts, resulting in a different plating rate on each of the plated electrode pads that are exposed to the electrolyte through the mask. For easy insertion of the test panel and for convenient handling of the container during electrolyte filling, removal, or rinsing, the entire connector assembly can be removed by un-tightening two bolts (one shown in FIG. 9A, indicated as 140). To prevent upside-down re-assembly of the connector, which will lead to improper connections, the holding bolts are designed asymmetrically, thus enabling assembly only in the proper position.

The electrical box can apply different currents and voltages to the test panel, so that the current range matches the properties of the tested properties. Also, optionally, sequentially stepping or scanning the current and voltages can expand the range of the measurements.

A typical test sequence consists of the following steps: (a) filling the container vessel with about 40 $cm^3$ of electrolyte; (b) inserting a test panel; (c) tightening the clamping bolt thus pressing (via the back-plate) the test panel against the mask; (d) attaching the electrical connector assembly; (e) turning on the power supply and the data acquisition system.

A main advantage of the tabletop device described herein is that the electrical connections can be made above the electrolyte level, thus keeping the electrical contacts free from corrosion and contamination and eliminating the need for careful sealing. Furthermore, it can be used for testing small samples of electrolyte (less than 30 $cm^3$) and can be easily assembled, disassembled, and cleaned.

This configuration lends itself to conveniently enhancing the convection by having gas (e.g., air) bubbled, or electrolyte circulated through each of the segmental compartment, for testing the effects of convective flow on the plating process. To provide for the flow, narrow holes or slits can be drilled into the walls or bottom of the segmental compartments formed by the mask. The flow form the externally mounted pump can be entered at the bottom plate of the container and then be split and directed into each of the plating compartments by drilling small holes in the mask at the bottom of each plating compartment. The holes can be identical in size (for uniform flow rate) or of different diameter, to generate different flows in each compartment. The flow will egress at the top of the slots within the mask, will flow towards the back wall through a groove provided from this application and will collect at the empty region of the container, from which it can be circulated by the pump. Because of the small volume, small cross-sectional areas, and small electrode areas, a small pump is sufficient.

Temperature control can be provided by an immersion heater, and the electrolyte temperature monitored using a thermocouple, a thermistor or a resistance thermometer (RTD). Also optionally, pH monitoring, ion sensing electrodes and/or electrolyte conductivity measurements can be carried out by inserting proper probe electrodes that are commercially available or that can be custom prepared, into the open region within the container where much of the electrolyte is held. The electrical currents for operating the heater, and the pump, and the signals from the sensors can be fed through the electrical connector assembly and the same multi-wire cable that carries the plating current.

The tabletop device can be provided with a cover that will minimize electrolyte evaporation and splashing and also be helpful in stabilizing the temperature. The cover which will fit over the container will have an appropriate slot to accommodate the insertion of the test panel.

While the invention has been specifically illustrated and described, those skilled in the art will recognize that the invention may be variously modified and practiced without departing from the concepts of the invention.

I claim:

1. An electrochemical device, comprising:

a cell with a plurality of discrete cathodic or anodic regions at which one or more electrochemical reactions occurs; and means for causing the one or more electrochemical reactions at each of the plurality of discrete regions whereby each of the one or more electrochemical reactions is measurable and quantifiable.

2. The device of claim 1, wherein the means for causing the one or more electrochemical reactions that occur at each of the plurality of discrete regions to be different.

3. The device of claim 1, wherein the means for causing the one or more electrochemical reactions at each of the plurality of discrete regions causes the one or more electrochemical reactions to proceed simultaneously and for the same amount of time.

4. The device of claim 3, wherein the means for causing the one or more electrochemical reactions cause the one or more electrochemical reactions to occur simultaneously at different current densities at each of the discrete regions.

5. The device of claim 4, wherein the one or more electrochemical reactions cause a discrete deposit at each of the discrete regions, each discrete deposit being a function of the current density at the discrete region of the discrete deposit.

6. The device of claim 4, wherein each of the discrete regions is disposed on a same substrate.

7. The device of claim 5, including:

means for measuring the current density at each of the discrete regions while the one or more electrochemical reactions occur simultaneously at different current densities at each of the discrete regions.

8. The device of claim 7, including:

means for measuring the voltage at each of the discrete regions while the one or more electrochemical reactions occur simultaneously at different current densities at each of the discrete regions.

9. The device of claim 1, wherein the electrochemical reactions occur at different reaction rates that take place sequentially at the distinctly different anodic or cathodic regions.

10. The device of claim 1, wherein the electrochemical reactions occur at different reaction rates that vary in a periodic fashion at the distinctly different anodic or cathodic regions.

11. An electrochemical device for simultaneously forming a plurality of electroplated deposits at a plurality of discrete cathodic or anodic regions at which one or more electrochemical reactions occurs; the electrochemical device comprising:

a cell and a plated, segmented substrate, the substrate having disposed therebetween a plurality of discrete cathodic or anodic regions at which one or more electrochemical reactions occurs.

12. The electrochemical device of claim 11 wherein the substrate is constructed of a dielectric material selected from the group comprising silicon, glass and plastic material.

13. The electrochemical device of claim 12 wherein the substrate has a conductive seed layer formed thereon, the conductive seed layer being constructed of a material selected from the group comprising of copper, nickel, brass, gold, and other conductive materials compatible with an electrochemical process.

14. The electrochemical device of claim 13 wherein the substrate has a conductive seed layer formed as a continuous conductive layer.

15. The electrochemical device of claim 14 wherein the substrate has a conductive seed layer formed by a vapor phase process, an electroless process, by lamination or gluing a conductive film onto the dielectric substrate.

16. The electrochemical device of claim 15 wherein the substrate has a conductive seed layer segmented into a plurality of discrete, electrically isolated sections.

17. The electrochemical device of claim 16 wherein the substrate has a conductive seed layer is segmented into a plurality of discrete, electrically isolated sections by grooves cut through the conductive seed layer between each of the discrete sections.

18. The electrochemical device of claim 11, wherein the substrate comprises a patterned printed circuit board having a pattern thereon that provides the plurality of discrete electrically isolated sections.

19. The electrochemical device of claim 14 wherein each of the plurality of discrete electrically isolated sections has a separate electrical contact attached thereto.

20. The electrochemical device of claim 19 further including means for directing a different current through separate current paths to or from each of the separate electrical contacts.

21. The electrochemical device of claim 20 further including resistors in each of the separate current paths to control the current to each separate electrical contact.

22. The electrochemical device of claim 1 wherein one or more of the discrete cathodic regions or anodic regions forms a reference electrode adapted to measure the potential in the electrolyte at the position where the reference electrode is located.

23. The electrochemical device of claim 11 wherein the cell incorporates an enclosure with a plurality of cavities therein, each cavity corresponding to one of the discrete cathodic or anodic regions whereby when the cell is assembled each of the discrete cathodic or anodic regions is exposed to an electrolyte and ionic current.

24. The electrochemical device claim 23 wherein the depth of the cavities ensure a uniform current density across the discrete cathodic or anodic regions formed on the substrate.

25. The electrochemical device of claim 11 wherein a counter electrode is not segmented and is disposed at a fixed distance from the substrate.

26. The electrochemical device of claim 25 wherein the substrate is a cathode, and the counter electrode is an anode formed of a material on which oxygen can evolve.

27. The electrochemical device of claim 26 wherein the anode is formed of a conductor selected from the group comprising platinum, gold, titanium, titanium coated with iridium oxide, ruthenium oxide, platinum, lead, or silver-lead alloy, and solubles such as copper and nickel.

28. The electrochemical device of claim 11 wherein:

the substrate is selected from the group including a segmented rotating disk electrode and a rotating segmented disk electrode surrounded by a ring electrode.

29. The electrochemical device of claim 11 wherein:

a central circular electrode that is not segmented; and the substrate is a surrounding electrode that is segmented to provide a plurality of electrodes.

30. The electrochemical device of claim 11 further including means for agitating or circulating the electrolyte, the means for agitating or circulating selected from the group comprising inert gas for agitation, air bubbling for agitation, a stirrer, and a pump.

31. A process for determining the quality of electroplated deposits comprising:

simultaneously depositing a plurality of discrete deposits, each deposit at one of a plurality of discrete cathodic or anodic regions at which one or more electrochemical reactions occurs; and causing the one or more electrochemical reactions at each of the plurality of discrete regions whereby each of the one or more electrochemical reactions is measurable and quantifiable.

32. The process of claim 31 wherein the one or more electrochemical reactions that occur at each of the plurality of discrete regions is different from the other reactions.

33. The process of claim 31 wherein each of the one or more electrochemical reactions at each of the plurality of discrete regions proceeds simultaneously and for the same amount of time.

34. The process of claim 31 wherein the one or more electrochemical reactions occur simultaneously at different current densities at each of the discrete regions.

35. The process of claim 34 wherein the one or more electrochemical reactions cause a discrete deposit at each of the discrete regions, each discrete deposit being a function of the current density at the discrete region of the discrete deposit.

36. The process of claim 35 including the step of measuring the current density at each of the discrete regions while the one or more electrochemical reactions occur simultaneously at different current densities at each of the discrete regions.

37. The process of claim 35 including the step of measuring the voltage at each of the discrete regions while the one or more electrochemical reactions occur simultaneously at different current densities at each of the discrete regions.

38. A method for calculating electrochemical process parameters in an electrochemical device having a plurality of distinctly different cathodic or anodic regions including:

measuring currents and voltages while at least one electrochemical reaction takes place at different measurable rates on a plurality of distinctly different cathodic or anodic regions in the electrochemical device.

39. The method of claim 38 wherein the different reaction rates take place simultaneously on the distinctly different cathodic or anodic regions.

40. The method of claim 38, wherein the process parameters are selected from the group comprising the polarization curve and the kinetics constants of the electrochemical reaction.

41. The method of claim 38, wherein the parameters are selected from the group comprising the electrolyte conductivity and the equilibrium potential.

42. The method of claim 38 wherein the electrochemical process parameters are comprised of the reactant ion diffusivity.

43. The method of claim 38, wherein the plurality of reactions on each region are comprised of two primary reactions, one a deposition reaction and one a gas evolution reaction.

44. The method of claim 38 wherein calculating electrochemical process parameters includes:

weighing or measuring the thickness of the deposit; and quantitative characterization of the current efficiency as function of the overall current or voltage.

* * * * *